US009836955B2

(12) United States Patent
Papay

(10) Patent No.: US 9,836,955 B2
(45) Date of Patent: Dec. 5, 2017

(54) TRAINABLE TRANSCEIVER FOR COMMUNICATION TO A FIXED OR MOBILE RECEIVER

(71) Applicant: GENTEX CORPORATION, Zeeland, MI (US)

(72) Inventor: Douglas C. Papay, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/064,416

(22) Filed: Mar. 8, 2016

(65) Prior Publication Data

US 2016/0267781 A1 Sep. 15, 2016

Related U.S. Application Data

(60) Provisional application No. 62/130,460, filed on Mar. 9, 2015.

(51) Int. Cl.
*G08C 17/02* (2006.01)

(52) U.S. Cl.
CPC ..... *G08C 17/02* (2013.01); *G08C 2201/20* (2013.01); *G08C 2201/91* (2013.01)

(58) Field of Classification Search
None
See application file for complete search history.

(56) References Cited

U.S. PATENT DOCUMENTS 7,864,070 B2 * 1/2011 Witkowski ..... G08C 19/28 340/12.24
8,253,528 B2 * 8/2012 Blaker ..... B60R 25/24 340/5.22
9,324,230 B2 * 4/2016 Chutorash
2013/0273870 A1 10/2013 Shi

FOREIGN PATENT DOCUMENTS

WO WO-2004/043750 A2 5/2004
WO WO-2013/019566 A1 2/2013

OTHER PUBLICATIONS

International Search Report and Written Opinion of the International Searching Authority dated Jun. 30, 2016, received in corresponding International Application No. PCT/US016/021388, 7 pages.

* cited by examiner

*Primary Examiner* — K. Wong
(74) *Attorney, Agent, or Firm* — Foley & Lardner LLP; Bradley D. Johnson

(57) ABSTRACT

A trainable transceiver for controlling a device includes an antenna array, at least one location sensor or connection to a location sensor, and a control circuit. The antenna array includes at least two antennas and is configured to direct a transmission. The control circuit is coupled to the antenna array and the at least one location sensor. The control circuit is configured to control the antenna array to direct the transmission along an antenna heading corresponding to a communication path between the trainable transceiver and the device, and wherein the control circuit is configured to determine the communication path based on (A) a location of the trainable transceiver determined by the control circuit based on information from the at least one location sensor and (B) a location of the device determined by the control circuit.

20 Claims, 8 Drawing Sheets

TRAINABLE TRANSCEIVER FOR COMMUNICATION TO A FIXED OR MOBILE RECEIVER

CROSS-REFERENCE TO RELATED APPLICATIONS

This applications claims the benefit of and priority to U.S. Provisional Application No. 62/130,460, filed Mar. 9, 2015, which is hereby incorporated by reference in its entirety.

FIELD

The present disclosure relates generally to the field of trainable transceivers for inclusion within a vehicle.

BACKGROUND

A trainable transceiver generally sends and/or receives wireless signals using a transmitter, receiver, and/or transceiver (e.g., using radio frequency transmissions). The wireless signals may be used to control other devices. For example, a trainable transceiver may send a wireless control signal to operate a garage door opener. A trainable transceiver may be trained to operate with a particular device. Training may include providing the trainable transceiver with control information for use in generating a control signal. Training may include enrolling the trainable transceiver with a device. A trainable transceiver may be incorporated in a vehicle (integrally or contained within the vehicle) and used to control devices outside the vehicle. It is challenging and difficult to develop a trainable transceiver which communicates with a fixed or mobile device using variable beam patterns and/or transmission directions. It is further challenging and difficult to develop a trainable transceiver which uses location/position information to enhance communication with a device.

SUMMARY

One embodiment relates to a trainable transceiver for controlling a device. The trainable transceiver includes an antenna array, at least one location sensor, and a control circuit coupled to the antenna array and coupled to the at least one location sensor. The antenna array includes at least two antennas and is configured to direct a transmission. The control circuit is coupled to the antenna array and the at least one location sensor. The control circuit is configured to control the antenna array to direct the transmission along an antenna heading corresponding to a communication path between the trainable transceiver and the device, and wherein the control circuit is configured to determine the communication path based on (A) a location of the trainable transceiver determined by the control circuit based on information from the at least one location sensor and (B) a location of the device determined by the control circuit.

Another embodiment relates to a method of controlling a transmission from a trainable transceiver to a device. The method includes determining, using a control circuit, the location of the trainable transceiver. The method includes determining the location of the device. The method includes determining, using the control circuit, an antenna heading corresponding to a communication path between the trainable transceiver and the device. The method includes transmitting, using an antenna and the control circuit, the transmission along the antenna heading. The trainable transceiver is configured to be capable of controlling the device based on at least one signal characteristic stored in memory.

DETAILED DESCRIPTION

Figure 1:
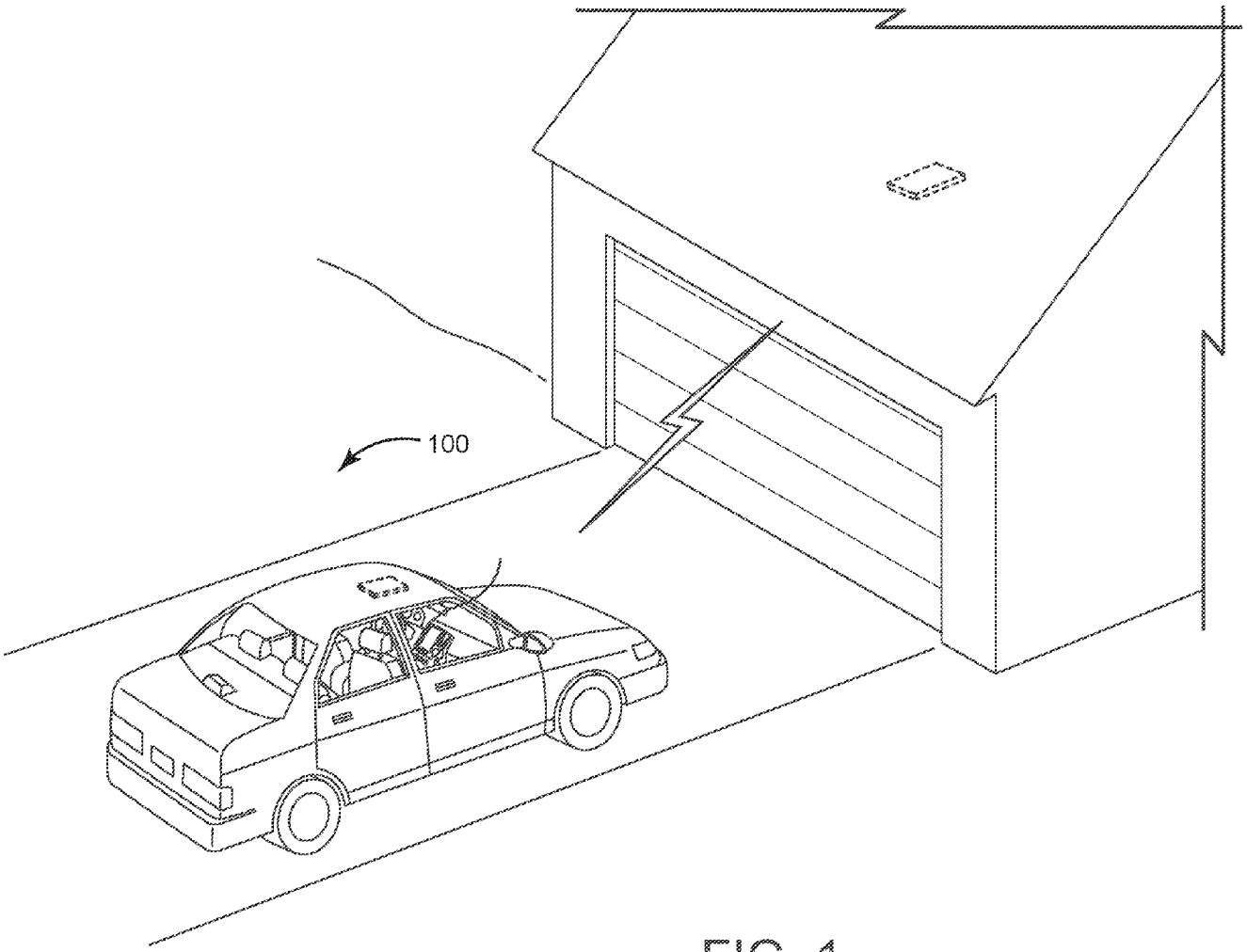
FIG. 1 illustrates a vehicle having a trainable transceiver, according to an exemplary embodiment.

Generally, a trainable transceiver controls one or more home electronic devices and/or remote devices. For example, the trainable transceiver may be a HomeLink trainable transceiver. The trainable transceiver sends activation and/or control signals to home electronic devices and/or remote devices in order to control or otherwise communicate with the devices. As described herein, a trainable transceiver according to some embodiments may direct a transmission towards a receiver or transceiver of a home electronics device and/or remote device. Advantageously, this may increase the communications range of the trainable transceiver, increase the reliability of communications between the trainable transceiver and the home electronics device and/or remote device, and/or otherwise improve communications. Also as described herein, a trainable transceiver according to some embodiments may scan a transmission in a plurality of directions and/or using a plurality of beam patterns. Advantageously, this may improve the chance that a transmission is received by a home electronics device and/or remote device. Following a general discussion of trainable transceivers, this and other embodiments of the trainable transceiver capable of directing transmissions are described with reference to the FIGURES.

With respect to trainable transceivers for controlling home electronics device and/or remote devices in general, home electronic devices may include devices such as a garage door opener, gate opener, lights, security system, and/or other device which is configured to receive activation signals and/or control signals. A home electronic device need not be associated with a residence but can also include devices associated with businesses, government buildings or locations, or other fixed locations. Remote devices may include mobile computing devices such as mobile phones, smartphones, tablets, laptops, computing hardware in other vehicles, and/or other devices configured to receive activation signals and/or control signals.

Activation signals may be wireless signals transmitted to a home electronic device and/or remote device. Activation signals may include control signals, control data, encryption information (e.g., a rolling code, rolling code seed, look-ahead codes, secret key, fixed code, or other information related to an encryption technique), or other information transmitted to a home electronic device and/or remote device. Activation signals may have parameters such as frequency or frequencies of transmission (e.g., channels), encryption information (e.g., a rolling code, fixed code, or other information related to an encryption technique), identification information (e.g., a serial number, make, model or other information identifying a home electronic device, remote device, and/or other device), and/or other information related to formatting an activation signal to control a particular home electronic device and/or remote device.

In some embodiments, the trainable transceiver receives information from one or more home electronic devices and/or remote devices. The trainable transceiver may receive information using the same transceiver used to send activation signals and/or other information to home electronic devices and/or remote devices. The same wireless transmission scheme, protocol, and/or hardware may be used for transmitting and receiving. The trainable transceiver may have two way communication with home electronic devices and/or remote devices. In other embodiments, the trainable transceiver includes additional hardware for two way communication with devices and/or receiving information from devices. In some embodiments, the trainable transceiver has only one way communication with a home electronic device. The trainable transceiver may receive information about the home electronic device from a remote device in a separate communication. The information about the home electronic device and/or remote device may be received from an intermediary device such as an additional remote device and/or mobile communication device.

A trainable transceiver may also receive information from and/or transmit information to other devices configured to communicate with the trainable transceiver. For example, a trainable transceiver may receive information from cameras (e.g., imaging information may be received) and/or other sensors. The cameras and/or other sensors may communicate with a trainable transceiver wirelessly (e.g., using one or more transceivers) or through a wired connection. In some embodiments, a trainable transceiver may communicate with mobile communications devices (e.g., cell phones, tablets, smartphones, or other communication devices). In some embodiments, mobile communications devices may include other mobile electronics devices such as a global positioning system or other navigation devices, laptops, personal computers, and/or other devices. In still further embodiments, the trainable transceiver is configured to communicate with networking equipment such as routers, servers, switches, hubs, gateways, and/or other hardware for enabling network communication. The network connected to the trainable transceiver may be a local network or the Internet and employ local application or cloud based computing techniques.

The trainable transceiver transmits and/or receives information (e.g., activation signals, control signals, control data, status information, or other information) using a radio frequency signal. For example, the transceiver may transmit and/or receive radio frequency signals in the ultra-high frequency range, typically between 260 and 960 megahertz (MHz), although other frequencies may be used (e.g., 2.4 GHz, the 5 to 5.8 GHz spectrum, etc.). In other embodiments, a trainable transceiver may include additional hardware for transmitting and/or receiving signals (e.g., activation signals and/or signals for transmitting and/or receiving other information). For example, a trainable transceiver may include a light sensor and/or light emitting element, a microphone and/or speaker, a cellular transceiver, an infrared transceiver, or another communication device.

The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and detect the control information of the received signal. In some embodiments, an original transmitter is a transmitter produced by the manufacturer of home electronics device, remote device, or other device for use specifically with the corresponding device. For example, an original transmitter may be a transmitter which is sold separately from a home electronics device, remote device, or other device but is intended to work with that device. The original transmitter may be a transmitter or transceiver that is part of a retrofit kit to add functions to an existing home electronics device, remote device, or other device. An original transmitter may be a transmitter or transceiver that is not manufactured by or under license from the manufacturer or owner of a home electronics device, remote device, or other device.

Referring to the FIGURES generally, a trainable transceiver which directs a transmission of a signal is illustrated according to some embodiments. The trainable transceiver may direct a transmission in one or more directions. The direction in which the trainable transceiver directs the transmission may be based on location/position information for the receiver intended to receive the transmission (e.g., a receiver or transceiver of a home electronics device and/or remote device). The direction in which the trainable transceiver directs the transmission may be based on location/position information for the trainable transceiver. The trainable transceiver may determine an antenna heading corresponding to a communication path between the location of the trainable transceiver and the location of the receiver (e.g., home electronics device, remote device, and/or other device). The antenna heading may be used to direct transmissions towards the receiver.

In some embodiments, the trainable transceiver steers the transmission such that the transmitted signal is scanned in a variety of directions. This may increase the statistical chance that the transmission is received by a particular home electronics device and/or remote device. In some embodiments, an acknowledgement signal received in response to a scanned transmission is used to direct further transmissions from the trainable transceiver to the home electronics device and/or remote device. The transmission may be shifted in order to improve communication during transmission.

The trainable transceiver may use one or more techniques and/or components to direct a transmission in a particular direction. In one embodiment, the trainable transceiver includes an antenna array which may be electronically steered. Each element of the antenna array may be individually controlled or phased to operate the array as a phased array. The antenna array may be used with one or more beamforming techniques (e.g., phasing) to direct a transmission from the antenna area towards a particular direction.

In other embodiments, other techniques may be used to direct a transmission. For example, the trainable transceiver may include a mechanically steered antenna. The antenna may be mechanically oriented in order to direct a transmission in a particular direction. For example, one or more motors attached to the antenna may be controlled by a control circuit in order to direct the antenna in a particular direction. In other embodiments, the trainable transceiver includes a plurality of antenna oriented in different directions. Each antenna element may correspond with a particular direction such that by selecting a particular antenna element or elements, a transmission can be directed in a particular direction. In further embodiments, one or more of these techniques may be used in conjunction with one another.

In some embodiments, the trainable transceiver is configured to transmit with various beam patterns. A specific beam pattern may be selected or a plurality of beam patterns may be used (e.g., as in scanning a transmission through a plurality of directions). In cases in which a specific beam pattern is selected, the beam pattern may be selected based on one or more factors and/or information such as the configuration of structural components of a vehicle in which the trainable transceiver is located, the location/position of the trainable transceiver relative to the location/position of the receiver to which the trainable transceiver is transmitting, and/or other factors. In other cases, the beam pattern may be adjusted throughout transmission in order to increase the chance that the transmission is received by a receiver (e.g., a mixture of directional beam patterns, omni direction beam patterns, weakly directional beam patterns, dipole beam patterns, and/or other beam patterns may be used for transmission). Beam patterns may be adjusted and/or selected by controlling a subset of antenna elements in an antenna array, using beamforming techniques, selecting specific antennas of a plurality of antennas, selecting specific types of antennas from a group of antennas having a plurality of antenna types, and/or other techniques for producing specific beam patterns.

In some embodiments, the directionality of the antenna and/or transmission is controlled based on the location of the trainable transceiver relative to the receiver to which the transmission is to be directed. In further embodiments, the beam pattern produced by the antenna(s) is controlled based on the location of the trainable transceiver relative to the receiver to which the transmission is to be directed. In these cases, the location of the trainable transceiver relative to the receiver may be determined using one or more techniques. In one embodiment, the trainable transceiver determined is location/position using one or more sensors included in the trainable transceiver. The trainable transceiver compares its location/position with the location/position of the receiver. The location/position of the receiver maybe stored in memory of the trainable transceiver (e.g., stored in memory when the trainable transceiver is trained). The location/position of the receiver may be received via communication with another device. In further embodiments, the location/position of the receiver may be determined based on received signal strength from a transmission received at the trainable transceiver from the receiver, based on an acknowledgement signal received from the receiver which corresponds to one of a plurality of directional signals previously transmitted by the trainable transceiver, and/or based on other information and/or techniques.

The trainable transceiver may use directional transmissions and/or specific beam patterns in a variety of applications. The trainable transceiver may use directed transmissions in order to improve communications with a fixed receiver (e.g., a home electronics device such as a garage door opener). The transmitted signal may be directed toward the fixed receiver and/or a narrow beam pattern used to improve the range of the trainable transceiver, improve signal strength at the receiver, improve the communications link in terms of reliability/performance, improve the bit error rate of communications, and/or otherwise improve communications. The trainable transceiver may use directional transmissions in order to improve communications between the trainable transceiver located in one vehicle and a second trainable transceiver located in a second vehicle. The two trainable transceivers may be in communication in order to exchange configuration information and/or other information for controlling one or more home electronics devices and/or remote devices. The trainable transceiver may use directed transmissions in order to improve communications with a mobile receiver (e.g., a remote device, receiver and/or trainable transceiver in a moving vehicle, etc.). The transmitted signal may be directed toward the mobile receiver and/or a narrow beam pattern used to improve the range of the trainable transceiver, improve signal strength at the receiver, improve the communications link in terms of reliability/performance, and/or otherwise improve communications.

Referring now to FIG. 1, a vehicle 100 is illustrated according to one embodiment. In some embodiments, a trainable transceiver is located within, mounted to, removably attached to, and/or otherwise associated with a vehicle 100. The trainable transceiver may be mounted or otherwise attached to a vehicle 100 in a variety of locations. For example, a trainable transceiver may be incorporated in a rear view mirror of the vehicle 100. A trainable transceiver may be integrated into a dashboard or center stack (e.g., infotainment center) of a vehicle 100. The trainable transceiver may be integrated into the vehicle 100 by a vehicle manufacturer. A trainable transceiver may be located in other peripheral locations. For example, a trainable transceiver may be removably mounted to a visor. The trainable transceiver may include mounting hardware such as a clip. A trainable transceiver may be mounted to other surfaces of a vehicle 100 (e.g., dashboard, windshield, door panel, in the head liner or other vehicle component). For example, a trainable transceiver may be secured with adhesive. In some embodiments, a trainable transceiver is integrated in a rear view mirror of the vehicle 100. The trainable transceiver or components thereof may be located anywhere within the vehicle 100 envelop including interior and exterior spaces or portions of the vehicle 100.

In other embodiments, a vehicle 100 may be retrofit to include a trainable transceiver. This may include attaching a trainable transceiver to a vehicle surface using a clip, adhesive, or other mounting hardware as described above. Alternatively, it may include replacing a vehicle 100 component with one that includes an integrated trainable transceiver and/or installing a vehicle component which includes an integrated trainable transceiver. For example, an aftermarket rear view mirror, vehicle camera system (e.g., one or more cameras and one or more display screens), and/or infotainment center may include an integrated trainable transceiver. In further embodiments, one or more components of a trainable transceiver may be distributed within the vehicle 100. For example and discussed in greater detail with respect to FIG. 3, an operator input device for receiving user input and/or providing output may be located within the vehicle 100 remotely from the antenna and/or other components of the trainable transceiver.

In one or more of these embodiments, the trainable transceiver may be installed, removably attached, or otherwise attached to or integrated with the vehicle 100 in a variety of locations. For example, the trainable transceiver or a portion thereof (e.g., an operator input device) may be included within a rearview mirror of the vehicle 100, in center counsel of the vehicle 100, in a dashboard of a vehicle 100, in a control console located on the headliner of a vehicle 100, and/or in other locations within the vehicle 100. In some embodiments, the trainable transceiver, or a portion thereof, is installed in a vehicle 100 by a vehicle manufacturer or retrofitter.

Still referring to FIG. 1, the vehicle 100 is illustrated as automobile. However, the vehicle 100 may be any type of vehicle. The vehicle 100 may be a car, truck, sport utility vehicle, tractor trailer, or other automobile. The vehicle 100 may be a motorcycle or other two or three wheeled vehicle. The vehicle 100 may be a non-automotive type (e.g., an all-terrain vehicle, a snowmobile, a tractor, etc.). In still further embodiments, the vehicle 100 may be an airborne vehicle (e.g., airplane, helicopter, etc.), or waterborne vehicle (e.g., boat, personal watercraft, etc.).

Figure 2:
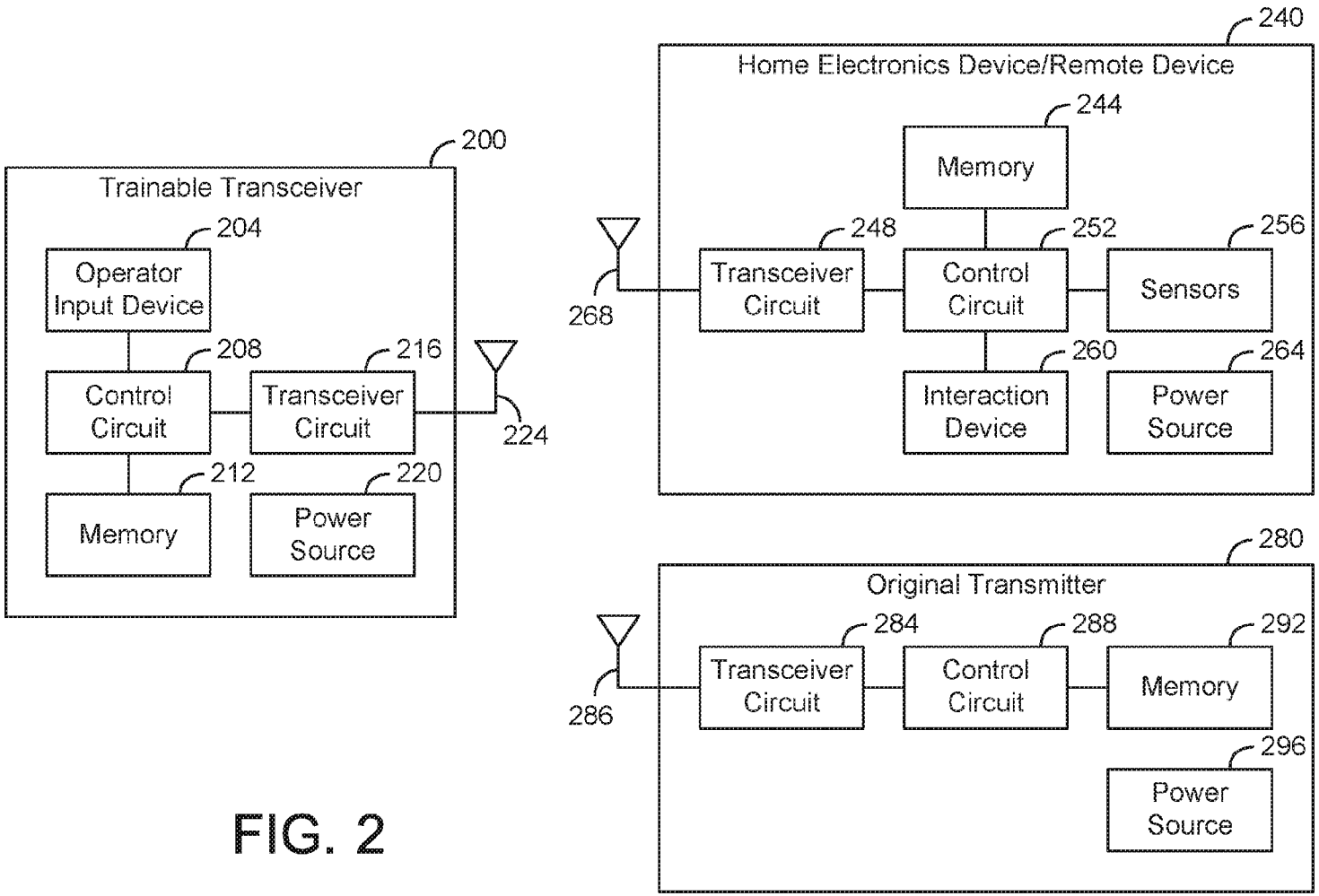
FIG. 2 illustrates a block diagram of a trainable transceiver, home electronics device, and original transmitter, according to an exemplary embodiment.

Referring now to FIG. 2, block diagrams of a trainable transceiver 200, home electronics device 240, and original transmitter 280 are illustrated according to one embodiment. The trainable transceiver 200 may include an operator input device 204, control circuit 208, memory 212, transceiver circuit 216, antenna 224, power source 220, and/or other components. The operator input device 204 is configured to receive user inputs and/or provide output to the user. In one embodiment, the operator input device 204 includes a series of buttons for receiving user input. In some embodiments, the operator input device 204 includes one or more light emitting diodes (LEDs) for providing output to the user. In further embodiments, the operator input device 204 includes one or more of switches, capacitive buttons, a touch screen display, liquid crystal display, microphone, speaker, and/or other input or output elements.

The control circuit 208 of the trainable transceiver 200 is configured to receive inputs from the operator input device 204. In response to inputs from the operator input device 204, the control circuit 208 may cause the transceiver circuit 216 to transmit an activation signal, control signal, and/or other signal. The control circuit 208 may use information in memory 212 in order to cause the transceiver circuit 216 to format a signal for reception by a particular home electronics device or remote device 240. For example, memory 212 may include an identifier of the device 240, encryption information, frequencies for use in transmitting to the device, and/or other information.

The control circuit 208 may also receive inputs via the operator input device 204 and in response place the trainable transceiver 200 into a training mode. While in the training mode, an activation signal transmitted by the original transmitter 280 may be received by the transceiver circuit 216 of the trainable transceiver 200. The control circuit 208 of the trainable transceiver 200 may store one or more characteristics of the received activation signal in memory for use in formatting control signals to be sent using the transceiver circuit 216. For example, stored characteristics may include, information identifying a home electronics device or remote device 240, encryption information, frequency, and/or other characteristics of the activation signal sent by the original transmitter 280 and received by the transceiver circuit 216 of the trainable transceiver 200. In some embodiments, the control circuit may cause the operator input device 204 to provide an output (e.g., illuminate an LED) when the signal from the original transmitter 280 is received and one or more characteristics are stored in memory 212.

In some embodiments, the control circuit 208 also controls the amount of power provided to the antenna 224 and/or transceiver circuit 216 for use in transmitting activation signals, control circuits, and/or otherwise transmitting. As explained in more detail with reference to FIG. 3, the control circuit 208 may include one or more modules which control the amount of power provided to the antenna 224. The amount of power provided to the antenna 224 may be controlled based wholly or in part on the orientation of the trainable transceiver 200. The orientation may be determined by the control circuit 208 based on input from one or more orientation/position sensors included in the trainable transceiver 200.

The trainable transceiver 200 also includes a power source 220 in some embodiments. In one embodiment, the power source 220 is or includes a vehicle power system. For example, the power source may be a vehicle power system including a battery, alternator or generator, power regulating equipment, and/or other electrical power equipment. In further embodiments, the power source 200 may include components such as a battery, capacitor, solar cell, and/or other power generation or storage equipment.

Referring to FIG. 2, the trainable transceiver 200 is configured to be trained to control a home electronics device and/or remote device 240. A home electronics device and/or remote device 240 may be any remotely controlled device. Examples of home electronics device and/or remote devices 240 include garage door openers, lighting control systems, movable barrier systems (e.g., motorized gates, road barriers, etc.), multimedia systems, and/or other systems controllable by an activation signal and/or control signal. Home electronics devices and/or remote devices 240 may include an antenna 268 and a receiver or transceiver circuit 248 for receiving transmissions from the trainable transceiver 200 and/or an original transmitter 280. Home electronics devices and/or remote devices 240 may also include a control circuit 252 and/or memory 244 for processing the received signal. For example, an activation signal from a trainable transceiver 200 or original transmitter 280 may be received by an antenna 268 and receiver circuit 248. The control circuit 252 may determine if encryption information transmitted as part of the activation signal matches an expected value. The control circuit 252 may cause an interaction device 260 to activate. For example, the home electronics devices and/or remote devices 240 may be a garage door opener and the interaction device 260 may be a motor for opening and/or closing the garage door. Upon receipt of the activation signal at the transceiver or receiver circuit 248, the control circuit 252 may activate the motor after determining that the activation signal included valid encryption information such as a key value.

Home electronics devices and/or remote devices 240 may include a power source 264 for powering the interaction device and/or other components. For example, the power source 264 may be a connection to a home, office, or other structure's power system (e.g., one or more circuits drawing power from mains power). The power source 264 may be or include other components such as a battery.

In further embodiments, home electronics devices and/or remote devices 240 may include additional components such as sensors 256. Sensors 256 may be or include cameras, light sensors, motion sensors, garage door position sensors, and/or other sensors. Home electronics devices and/or remote devices 256 may use a transceiver circuit 248 to transmit information from or determined based on the sensors to the trainable transceiver 200. The trainable transceiver 200 may display this information using the operator input device 204.

Still referring to FIG. 2, home electronics devices and/or remote devices 240 may be sold with or otherwise be associated with an original transmitter 280. An original transmitter 280 may be a transmitter provided by the manufacturer of the home electronics devices and/or remote devices 240 for wirelessly controlling the home electronics devices and/or remote devices 240. In alternative embodiments, the original transmitter 280 may be a transmitter sold separately from the home electronics device and/or remote device 240 which is configured to control the home electronics device and/or remote device 240. For example, the original transmitter 280 may be a retrofit product, trainable transceiver, and/or other transmitter configured to control the home electronics device and/or remote device 240.

In some embodiments, the original transmitter 280 includes a transceiver circuit 284, control circuit 288, memory 292, power source 296, and/or other components. The transceiver circuit 284 may be a transceiver or transmitter and may be coupled to and/or include an antenna 286. The control circuit 288 may control the transceiver to format and transmit an activation signal and/or control signal based on information stored in memory 292 (e.g., device identification information, encryption information, frequency, and/or other information). The control circuit 288 may also handle inputs received from an operator input device such as a button included in the original transmitter 280. The original transmitter 280 may have a power source 296 such as a battery.

Figure 3:
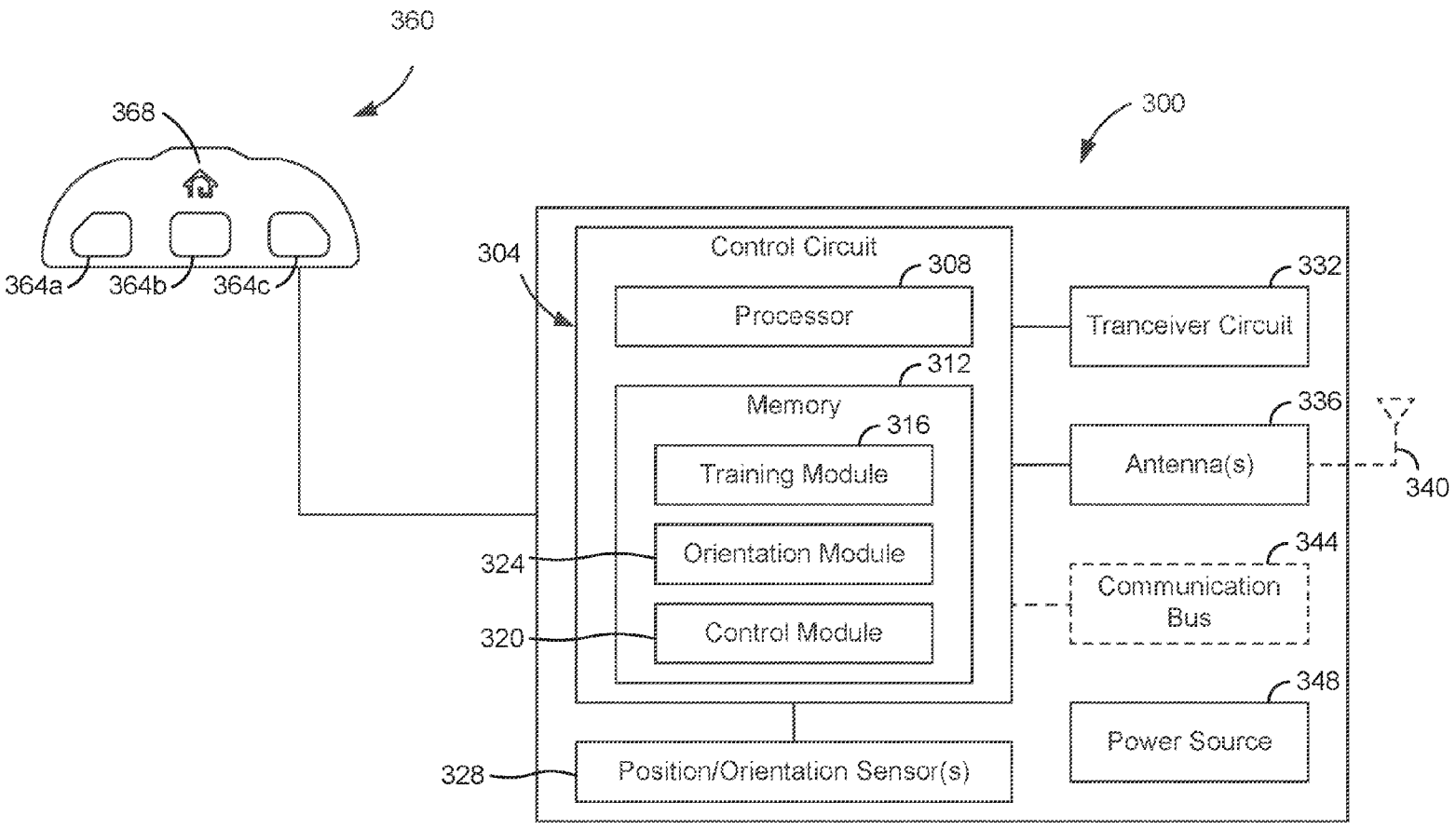
FIG. 3 illustrates a trainable transceiver including a remote operator input device and location/position sensor(s), according to an exemplary embodiment.

Referring now to FIG. 3, a block diagram of a trainable transceiver 300 and an operator input device 360 is illustrated according to one embodiment. A trainable transceiver 300 and an operator input device 360 may include one or more of the components or features illustrated and described with reference to FIG. 3 and/or one or more of the components or features illustrated and described with reference to FIG. 2.

In one embodiment, the operator input device 360 includes a series of buttons 364*a-c* and an illuminable logo 368, design, light, or other feature. Each button 364 may be trained to operate a different home electronics device and/or remote device 240 using one or more of the training procedures described herein. The illuminable feature of the operator input device 360 may be used to communicate information to the user of the trainable transceiver 300.

Still referring to FIG. 3, the trainable transceiver 300 may include components located remotely from the operator input device 360. One or more of these components (e.g., the control circuit) may be in communication with the operator input device 360. In one embodiment, a wired connection allows for communication between the operator input device 360 and the other components of the trainable transceiver 300. In alternative embodiments, a wireless connection between the operator input device 360 and the other components is used. The operator input device 360 may include a wireless transceiver configured to communicate with the other components using the transceiver circuit 332 and/or a second transceiver (e.g., WiFi transceiver, Bluetooth transceiver, optical transceiver, and/or other transceiver) located with the other components remote from the operator input device 360. In further alternative embodiments, the trainable transceiver 300 does not include components located remotely from the operator input device 360. The components of the trainable transceiver 300 may be located in substantially the same location (e.g., housed within a single housing).

The trainable transceiver 300 includes a transceiver circuit 332 and/or one or more antennas 336, 340 included in or coupled to the transceiver circuit. The antenna(s) 336, 340 may be located in the same housing and/or same location as other components of the trainable transceiver 300 (e.g., the transceiver circuit, control circuit, operator input device, and/or other components). The antenna(s) 336, 340 may extend from within the housing of the trainable transceiver 300 to the space outside of the housing. Exterior portions of the antenna(s) 336, 340 may be housed within other vehicle components (e.g., within a rear view mirror, within a headliner, within a dashboard, in an engine bay, etc.). In alternative embodiments, the antenna(s) 336, 340 are located remotely from one or more components of the trainable transceiver 300. The antenna(s) 336, 340 may be coupled to other components of the trainable transceiver (e.g., transceiver circuit, control circuit, power source, and/or other components) via a wired or wireless connection.

In one embodiment, the trainable transceiver includes only a single antenna 336. The antenna 336 may be mechanically scanned in order to direct transmissions from the trainable transceiver 300. For example, the antenna 336 may be coupled to one or more electric motors, solenoids, servo motors, stepper motors, and/or other mechanical devices for providing movement. The orientation, direction, and/or position of the antenna 336 may be controlled by the control circuit 304 and/or the control module 320. The control circuit 304 (e.g., as executing an instruction or program in the control module 320) may control the mechanical device(s) which mechanically position the antenna 336. Thus, the control circuit 304 may cause the antenna 336 to be directed such that transmissions from the antenna 336 are transmitted in a particular direction.

In other embodiments, the trainable transceiver 300 includes more than one antenna (e.g., one or more of antenna 336 and/or antenna 340, etc.). The trainable transceiver 300 may include a plurality of antennas 336 having the same orientation a plurality of orientations. The antenna 336 may be a phaseable array of multiple antenna elements (e.g., an actively phased array). The antenna(s) 336 may be all of a single type (e.g., all dipole antennas). In other embodiments, the antennas 336 may include antennas of different types (e.g., one or more dipole antennas and one or more loop antennas). The different antennas 336 may produce different beam patterns. The control circuit 304 and/or control module 320 may control the antennas 336 in order to produce transmissions in a particular direction. This may include selecting one or more antennas 336 with orientation(s)

different from other antennas 336, phasing the antennas 336, delaying signals between transmitter/receiver for each antenna 336 and the feedpoint of the antennas 336, timing the transmissions from each antenna 336 separately, and/or otherwise controlling the antennas 336 with selection techniques, phasing techniques, beamforming techniques, or other control techniques. The control circuit 304 and/or control module 320 may further control the beam pattern produced by the antennas 336. For example, the beam pattern may be controlled by controlling the power provided to one or more antennas 336, the selection of particular antennas 336 used to transmit, controlling the antennas 336 using beamforming techniques, and/or otherwise controlling the antennas 336.

In one embodiment, the antenna 336 is a phased array antenna having at least two antennas or antenna elements. Beamforming is achieved by the control circuit 304 and/or control module 320 delaying the transmission of the signal a specific (e.g., different amount) for each antenna element or antenna of the phased antenna array. In other words, the signal from the transceiver circuit 332 to each antenna element is delayed; the signal between the transceiver circuit 332 and the feedpoint for each antenna element is delayed. Antennas and/or antenna elements of the antenna array may be different types, have different antenna sizes, have a variety of distances between each antenna and/or element, have different transmission lines between the transceiver circuit and the antenna and/or antenna element, and/or otherwise be alternatively configured in alternative embodiments.

The antenna(s) 336, 340 may be configured to receive a variable amount of power. For example, the amount of power provided to the antenna 336 is controlled by the control circuit 304 and/or transceiver circuit 332. For example, the control circuit 304 and/or transceiver circuit 332 may include power regulation components such as voltage dividers, current dividers, transformers, diodes, capacitors, and/or other electronics which can control the amount of power provided to the antenna 336. The power may be provided from the power source.

The antenna 336 may be one or a combination of a variety of antenna types. For example, the antenna 336 may be or include a dipole antenna, loop antenna, slot antenna, parabolic reflector, horn, monopole, helical, and/or other type of antenna. The antenna 336 may be omnidirectional, weakly directional, or directional.

The trainable transceiver 300 may include one or more location/position sensors 328 (e.g., location, position, and/or orientation sensors). The one or more location/position sensors 328 are coupled to the control circuit 304 and configured to provide information related to the location and/or position of the trainable transceiver 300. In cases in which the trainable transceiver 300 includes the antenna 336 in the same housing as other components, the location/position sensor(s) 328 are included within the housing as well. In cases where the antenna 336 is located remotely, the location/position sensor(s) 328 may be located with the antenna 336. This allows the location/position sensor(s) 328 to provide information used by the control circuit 304 to determine the location and/or position of the antenna 336. In further embodiments, the control circuit 304 and/or location/position module 324 (e.g., orientation module) may determine the location of the antenna(s) 336 based on the location information provided by the location/position sensor(s) 328 even if the antenna(s) 336 are located remote from the sensors 328. For example, the control circuit 304 and/or location/position module 324 may determine the location/position of the antenna(s) 336 based on location/position data for the trainable transceiver 300 and a known location/position of the antenna(s) 336 with respect to the location/position sensor(s) 328.

In some embodiments, the location/position sensor(s) 328 is or include a global positioning system (GPS) receiver. The GPS receiver may receive information from a GPS. For example, the GPS receiver may receive the latitude and/or longitude of the trainable transceiver from the GPS.

In some embodiments, the location/position sensor(s) 328 is or include a triangulation system. For example, the location/position sensor 328 may triangulate signals from one or more cell towers of a cellular communication network in order to determine the location/position of the trainable transceiver 300. In other embodiments, other signals may be triangulated. For example, a radio navigation system may be used to determine the location/position of the trainable transceiver 300.

In some embodiments, the location/position sensor(s) 328 is or includes a dead reckoning system. The dead reckoning system may determine the position of the trainable transceiver 300 using information from vehicle systems such as wheel speeds and/or headings. The dead reckoning system may be any type and/or configuration of dead reckoning system.

In some embodiments, the location/position sensor(s) 328 include one or more other sensors for determining location/position and/or changes in location/position. In further embodiments, the location/position sensor 328 is or includes a multi-axis accelerometer. In additional embodiments, the location/position sensor(s) 328 include one or more of a multi-axis accelerometer, single axis accelerometers, magnetometers, inclinometers, gyroscopes, compass, and/or other sensors for determining location/position and/or changes in location/position. The location/position sensor 328 may be or include an integrating multi-axis accelerometer. In still further embodiments, the location/position sensor(s) 328 includes one or more sensors of the types described above and/or other types for measuring orientation, location, position, and/or changes in location/position. The location/position sensors 328 may measure or otherwise provide information related to the location/position of the trainable transceiver 300.

In still further embodiments, the trainable transceiver 300 may use location and/or position information received from another source. The trainable transceiver 300 may not include dedicated location/position sensor(s) 328. For example, the control circuit 304 may be in communication with one or more vehicle systems with location and/or position sensors 328. The trainable transceiver 300 may include a communication 344 bus for communicating with other systems of the vehicle 100. For example, the trainable transceiver 300 may communicate with other vehicle systems (e.g., vehicle navigation, infotainment, connectivity, or other systems) using a controller area network (CAN) bus in order to retrieve location/position information from vehicle sensors. The trainable transceiver 300 may receive position information from a GPS included within the vehicle 100. In other embodiments, the trainable transceiver 300 may be in communication with a device such as smartphone, tablet, or other mobile computing device. The trainable transceiver 300 may receive location and/or position data from this or another device. The trainable transceiver 300 may be in communication with other sources of location/position information using a wired connection, the transceiver circuit 332, and/or other transceiver circuits (e.g., a Bluetooth transceiver).

The control circuit 304 of the trainable transceiver 300 may include one or more modules in memory 312 for carrying out and/or facilitating the operation of the trainable transceiver 300 described herein. For example, the control circuit 304 may include a training module 316 in memory 312. The training module 316 may include instructions, programs, executable code, and/or other information which is used by the control circuit 304 to perform training functions. The modules of the control circuit 304 may be executed or otherwise handled or implemented using a processor 308. The processor 308 may be a general or application specific processor or circuit for performing calculations, handling inputs, generating outputs, and/or otherwise performing computational tasks. For example, when a specific input is received by the control circuit 304 (e.g., a button depressed for greater than 5 seconds), the training module 316 may include instructions for handling the input. The training module 316 may cause the control circuit 304 to use the transceiver circuit 332 to wait for the reception of a signal from an original transmitter 280. The training module 316 may include instructions and/or programs for analyzing the received signal using one or more algorithms, look up tables, and/or other information structures/techniques. The training module 316 may also cause the storage of one or more characteristics of the received signal in memory 312.

In some embodiments, the memory 312 associated with the control circuit 304 includes a location/position module 324 (e.g., orientation module). The location/position module 324 may include instructions, programs, executable code, and/or other information which is used by the control circuit 304 to determine the location and/or position of the trainable transceiver 300 and/or antenna 336. The location/position module 324 may include instructions and/or programs which handle input received from one or more location/position sensor(s) 328. For example, the location/position module 324 may use formulas, algorithms, look up tables, and/or other techniques to calculate or otherwise determine the location/position or estimated location/position of the trainable transceiver 300 (and/or antenna 336) based on the received inputs. The location/position module 324 may determine current location/position using information received from a GPS via a GPS receiver. The location/position module 324 may determine changes in location/position based on information received from one or more accelerometers (e.g., determine changes in orientation based on the measurements received, track location/position by integrating the changes in orientation, etc.). The location/position module 324 may receive inputs from any set or subset of the location/position sensors 328 described herein for use in determining the location/position of the trainable transceiver 300 and/or the antenna 336. In some embodiments, the location/position module 324 extrapolates the determined location and/or position of the trainable transceiver 300 in order to determine the orientation and/or position of the antenna 336. The location/position module 324 may include the use of algorithms such as Kalman filters, dynamic filters, and/or other algorithms for determining motion, orientation, location and/or position.

The control circuit 304 may further include a control module 320. The control module 320 may include instructions, programs, executable code, and/or other information which is used by the control circuit 304 to control the direction of transmission from the antenna(s) 336, 340, the beam pattern of transmissions from the antenna(s) 336, 340, power provided to the antenna(s) 336, 340 and/or otherwise control the antenna(s) 336, 340 and/or transmission characteristics. The control module 320 may control the antenna(s) 336, 340 (e.g., to direct a transmission in a certain direction) based on the location/position of the trainable transceiver 300 and/or antenna 336 determined by the control circuit 304 (e.g., using the location/position module 324). A program, instructions, and/or other portion of the location/position module 328 may provide the control module 320 with the determined location/position of the trainable transceiver 300 and/or of the antenna 336. The control module 320 may use this information alone or in conjunction with a determined location of a receiver (e.g., home electronics device and/or remote device 240) in order to control the direction, beam pattern and/or signal strength of a transmission. For example, the control module 320 and/or the location/position module 324 may include lookup tables, formulas, programs, functions, and/or other instructions or techniques for determining a signal path between the trainable transceiver 300 and/or antenna 336 and the receiver (e.g., home electronics device and/or remote device 240). The signal path may be or be associated with a heading from the trainable transceiver 300 and/or antenna(s) 336 towards the receiver (e.g., an antenna heading). The control module 320 controls the antenna(s) 336 (e.g., by phasing an array of antennas) in order to direct the transmission towards the receiver and along the signal path and/or heading associated with the signal path.

In some embodiments, the control circuit 304 and/or training module 316 is configured to learn the location of the receiver (e.g., home electronics device and/or remote device 240). For example, the control circuit 304 can be configured to cause the antenna 336 to transmit a request signal (e.g., a ping) to the receiver, and store in memory 312 an acknowledgement signal received from the receiver in response to the request signal. In some embodiments, the control module 304 is configured to transmit a plurality of request signals in a plurality of directions, and store acknowledgement signals and/or a signal strength of acknowledgement signals in memory 312 in association with the plurality of directions. Based on the received acknowledgement signals and/or signal strengths associated with the plurality of directions, the control module 304 may be configured to optimize future transmissions to the receiver, such as by only transmitting to the receiver along directions (e.g., antenna headings) associated with an acknowledgement signal having been received, associated with a signal strength greater than a threshold signal strength, associated with a maximum signal strength, etc.

In further embodiments, the control circuit 304, control module 320, and/or location/position module 324 may use information about the location/position of the trainable transceiver 300 and/or antenna 336 to control the beam pattern of a transmission. In some embodiments, the control circuit 304, control module 320, and/or location/position module 324 may also use information about the location/position of the receiver in order to control the beam pattern of a transmission. For example, if the location/position module 324 determines that the receiver and the trainable transceiver 300 are located within a threshold distance, the control module 320 and/or control circuit 304 may control the antenna(s) 336 such that a omni direction beam is produced. If the trainable transceiver 300 and the receiver are located at a distance greater than the threshold, a directional beam pattern may be used in the transmission. The transmission may be along a signal path from the trainable transceiver 300 to the receiver (e.g., home electronics device and/or remote device 240).

In further embodiments, the control circuit 304, control module 320, and/or location/position module 324 may use information about the location/position of the trainable transceiver 300 and/or antenna 336 to control the amount of power provided to the antenna(s) 336 for a transmission. In some embodiments, the control circuit 304, control module 320, and/or location/position module 324 may also use information about the location/position of the receiver in order to control the amount of power provided to the antenna(s) 336 for a transmission. For example, if the location/position module 324 determines that the receiver and the trainable transceiver 300 are located within a threshold distance, the control module 304 and/or control circuit 308 may cause the transceiver circuit 332 to provide the antenna(s) 336 with a first amount of power for the transmission. If the trainable transceiver 300 and the receiver are located at a distance greater than the threshold, the control module 320 and/or control circuit 304 may cause the transceiver circuit 332 to provide the antenna(s) 336 with a second greater amount of power for the transmission.

In some embodiments, the control circuit 304, control module 320, and/or location/position module 324 stores the location of a receiver (e.g., home electronics device and/or remote device 240) in memory 312 when the trainable transceiver 300 is trained to control the device associated with receiver. For example, the trainable transceiver 300 is likely to be trained to control a device near that device. The trainable transceiver 300 may be trained by receiving an activation signal from an original transmitter 280 associated with the device and/or transmitting an activation signal to a device while the device is in learn or enrollment mode. As part of the training process, the trainable transceiver 300 may store in memory the location 312 and/or position of trainable transceiver 300 during training as the location/position of the device which the trainable transceiver 300 has been trained to control. The trainable transceiver 300 may use information from the location/position sensor(s) 328 and/or location/position module 324 to determine the location and store this in memory 312. The location/position of the receiver and/or device may be stored associated with an input mechanism of the operator input device 368 (e.g., one of three buttons). Multiple locations/positions, each corresponding to one device the trainable transceiver 300 is trained to control, may be stored. This allows the trainable transceiver 300 to control a plurality of devices using the direction transmission, beamforming, signal strength modification techniques, and/or other techniques described herein.

Still referring to FIG. 3, the trainable transceiver 300 includes an operator input device 360 located remotely from one or more other components of the trainable transceiver 300 in some embodiments. For example, in embodiments in which the trainable transceiver 300 is installed in or otherwise integrated with a vehicle 100, the operator input device may 360 be located within the cabin of the vehicle 100, and one or more other components of the trainable transceiver 300 may be located in other locations (e.g., in an engine bay, in a trunk, behind or within a dashboard, in a headliner, elsewhere in the cabin and/or in other locations). This may allow for installation of the trainable transceiver 300, including the antenna 336, in a variety of locations and/or orientations. Advantageously, this may allow for the antenna(s) 336 of the trainable transceiver 300 to be installed, mounted, or otherwise located in or on the vehicle 100 in a position with less interference from vehicle structural components.

In some embodiments, the trainable transceiver 300 controls the directionality of transmissions and/or the beam patterns of transmissions to compensate for vehicle structural elements. Advantageously, this may increase the number and/or types of locations in which the trainable transceiver 300 may be mounted, installed, or otherwise located without affecting the performance (e.g., range, communications reliability, etc.) of the trainable transceiver 300. Vehicle structural elements which may interfere with a transmission include A pillars, B pillars, C pillars, roof surfaces, trunk surfaces, hood surfaces, windows, windshields, doors, and/or other vehicle components. In some embodiments, the antenna(s) 336 of the trainable transceiver 300 are located within the cabin of the vehicle 100 (e.g., installed or mounted within a rearview mirror, center console, and/or other location). In these cases, vehicle structural elements may particularly interfere with transmissions from the trainable transceiver 300. To compensate, the trainable transceiver 300 may use one or more of the techniques described herein for beamforming and or producing a specific beam pattern to avoid and/or otherwise compensate for vehicle structural elements. The trainable transceiver 300 may increase antenna power, enhance signal strength, mask signal strength, produce a beam pattern which at least partially avoids vehicle structures, steer a transmission away from vehicle structures, and/or otherwise compensate for vehicle structures which may reduce the performance of the trainable transceiver 300.

In some embodiments, the trainable transceiver 300 may be provided with information (e.g., through the operator input device 360, through programming prior to installation, through a signal received at the trainable transceiver 300 including configuration information, etc.) used to compensate for vehicle structural elements. For example, the information may include the type, make, model, and/or other information about the vehicle 100 in which the trainable transceiver 300 is mounted, installed, or otherwise located in. The information may further include information such as the mounting location, mounting orientation, and/or other information about how the trainable transceiver is oriented in the vehicle 100. Information may be received from a user via the operator input device 360, via a signal received at the antenna(s) 336 and transceiver circuit 332 from a programming tool, mobile phone, computing device and/or other source of wireless signals, and/or otherwise provided to the trainable transceiver 300.

The trainable transceiver 300 may use this information to determine (e.g., using the control circuit 304 and/or a module such as the location/position module 324) the orientation and/or location of vehicle structural elements in relationship to the trainable transceiver 300 and/or an antenna(s) 336 included in the trainable transceiver 300. For example, the control circuit 304 and/or a module may use one or more lookup tables to determine the location of structural elements corresponding to a make, model, year, and/or other information about the vehicle 100 in which the trainable transceiver 300 is installed. The trainable transceiver 300 may also use lookup tables to determine its own location, orientation, and/or position based on the information received at the trainable transceiver 300 related to the installation, mounting, and/or location of the trainable transceiver 300. Using this information, the control circuit 304 and/or module may determine a beam pattern and/or direction in which to transmit signals to avoid the vehicle structural elements or otherwise compensate for vehicle structural elements. For example, lookup tables, algorithms, models, and/or other software, functions, or techniques may be used to determine a beam pattern and/or transmission direction. The trainable transceiver 300 may further use the information to determine the signal strength, and/or other parameters of the transmission to avoid, partially or completely, and/or compensate for vehicle structural elements. In some cases, the beam pattern produced during a transmission may be directed, shaped, or otherwise controlled to partially avoid the vehicle structural elements. Vehicle structural elements may still have some impact on the transmission although the impact may be lessened by the directional control of the transmission and/or the control of the beam pattern of the transmission. In other embodiments, the transmission is controlled such that the vehicle structural elements are completely or substantially avoided. The vehicle structural elements may have no or little impact on the transmission.

Referring to the FIGS. 3-8 generally, a trainable transceiver 300 which directs a transmission of a signal to a fixed or mobile receiver is illustrated according to some embodiments. The trainable transceiver 300 may determine (e.g., using the control circuit 320 and location/position module 324) the location/position of the trainable transceiver 300. The location/position of a receiver to which the trainable transceiver 300 is transmitting may be known (e.g., stored in memory 312 during the training process). The trainable transceiver 300 may determine (e.g., using the control circuit 304 and location/position module 324) an antenna heading based on the location/position of the trainable transceiver 300 and the receiver and electrically phase, by hardware control or software control, two or more antennas to form a beam of radio frequency energy for transmission of a signal to the receiver along the antenna heading and along a communications path GPS or other land and/or space based positioning system may be used to determine the location of the trainable transceiver 300 and the receiver for use in computation of the antenna heading. In the case of a fixed receiver (e.g., a home electronics device 240 such as a garage door opener), the location/position of receiver can be stored at point of training/enrollment of the trainable transceiver 300 to set fixed position of receiver. In the case of a mobile receiver (e.g., a remote device, such as a second trainable transceiver 300, located in another moving vehicle 100), positions of both the trainable transceiver 300 and the receiver are used to determine the antenna heading the transmission. The position of the trainable transceiver 300 in relationship to a fixed receiver (e.g., a garage door opener) or mobile receiver (e.g., a second trainable transceiver) may be utilized to choose between omni directional or beam forming/phased array operation. Radio systems in close proximity may utilize an omni directional antenna, where radio systems at a greater distance from each other may utilize directional antenna operation. The trainable transceiver 300 may shift the beam during transmission plus or minus the calculated heading by the beam width used in the transmission, or some other amount, to improve link reliability/performance. In the case of a fixed receiver (e.g., a garage door opener), a single message packet may be transmitted repeatedly by the trainable transceiver 300. Therefore, the trainable transceiver 300 may steer a beam during transmission to effectively increase the beam width without decreasing gain and minimizing loss of information at the receiver. Steering the beam during transmission statistically improves the chances of the receiver receiving the signal.

Figure 4:
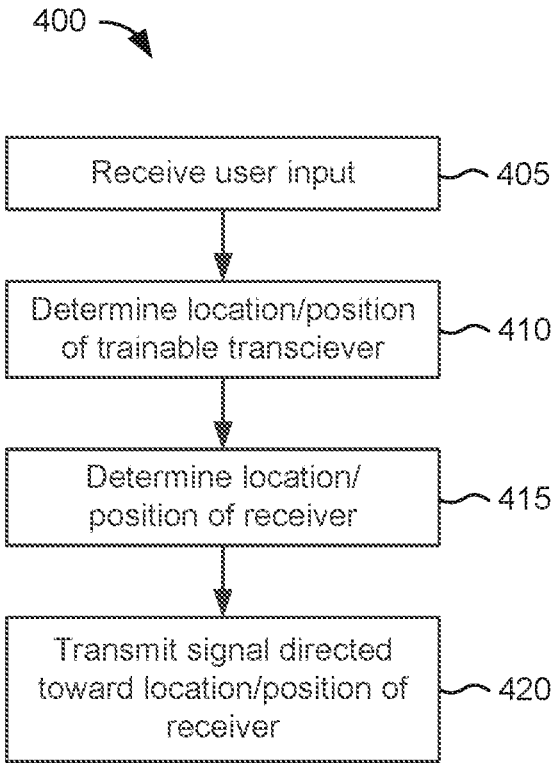
FIG. 4 illustrates a flow chart for a method of controlling the transmission of a signal from the trainable transceiver based on location/position information, according to an exemplary embodiment.

Referring now to FIG. 4, a flow chart 400 is illustrated for a method of controlling transmissions by the trainable transceiver (e.g., trainable transceiver 300, etc.) using location/position information. At 405, the trainable transceiver may receive a user input which corresponds to transmitting a signal. For example, the input may be a button press corresponding to sending an activation signal formatted to control a device (e.g., home electronics device and/or remote device) the trainable transceiver has been trained to control. In some embodiments, the trainable transceiver may be trained to control a plurality of devices with each device associated with a different input option of operator input device (e.g., three different buttons corresponding with three devices). In further embodiments, the input may be related to communication with the device other than for controlling the device. For example, the input may correspond with providing or retrieving status information to or from the device.

At 410, in response to receiving the user input, the trainable transceiver determines the location/position of the trainable transceiver. In some embodiments, the control circuit and/or location/position module of the trainable transceiver receives location/position information from location/position sensor(s) included in the trainable transceiver. For example, the control circuit may request location information from a location sensor such as a GPS receiver. The control circuit and/or location/position module may process the information to determine the location of the trainable transceiver. For example, GPS information may be used to determine the latitude and longitude of the trainable transceiver.

In alternative embodiments, the location/position information may be retrieved from other sources. For example, the location/position information may be retrieved from a vehicle sensor (e.g., dead reckoning system, GPS receiver) or mobile device (e.g., mobile phone or computer) in communication with the trainable transceiver. In some alternative embodiments, the trainable transceiver uses one or more other location/position sensors such as a dead reckoning system, accelerometers, gyroscopes, radio navigation systems, and/or other sensors to determine the position of the trainable transceiver. Location/position information may be provided to a trainable transceiver or exported from a trainable transceiver using a mobile phone and/or application running on the mobile phone which is in communication with the trainable transceiver. For example, the mobile phone may be in communication with the trainable transceiver using a Bluetooth transceiver included in the mobile phone and a Bluetooth transceiver included in the trainable transceiver. The application may cause position/location information for the trainable transceiver and/or a home electronics device, remote device, or other device to be stored remotely (e.g., stored in cloud computing architecture) which allows for retrieval of the location/position information by the trainable transceiver and/or other devices (e.g., other mobile phones and applications).

At 415, the trainable transceiver also determines the location/position of the receiver (e.g., receiver or transceiver of a device) to which the transmission corresponds. For example, the receiver may be a home electronics device, remote device, or other device. In some embodiments, the receiver and/or device is at a fixed location. For example, the device is a home electronics device such as a garage door opener. In this case, the location/position of the device may be determined by the trainable transceiver (e.g., using the control circuit and/or location/position module) by retrieving location/position information from memory corresponding to the device. For example, when the trainable transceiver is trained to control the device, the current location of the trainable transceiver, as determined by the control circuit based on the location/position sensors and/or other source of location/position information, is stored in memory as the location of the particular device. In some embodiments, the trainable transceiver determines the location of the receiver and/or an antenna heading to use in the transmission based on user input receiver via the operator input device. For example, the user may be prompted to select a direction in which to transmit which corresponds to a general direction in which the receiver is located. Alternatively, a user may manually provide location/position information for the receiver, a transmission direction, and/or a particular beam pattern for transmission using the operator input device.

In some embodiments, the receiver and/or device is mobile. For example, the device is a remote device, other trainable transceiver located in a moving vehicle, transceiver associated with a vehicle, or other device which may be moving or be movable between locations. In this case, the location/position of the device may be determined by the trainable transceiver (e.g., using the control circuit and/or location/position module) by receiving location/position information from another source. The other source may be the device itself, a connection to the Internet or other network allowing for communication with the device or a storage device containing location information for the device, a mobile phone in communication with both the trainable transceiver and the device, and/or other sources. In some embodiments, the other source is a series of intermediate transceivers which relay the location/position of the device to the trainable transceiver. The trainable transceiver may acquire location/position information related to a mobile device using a transceiver and/or communication protocol of a different type than used for direct communication between the trainable transceiver and the device. For example, Bluetooth communication, cellular communication, Internet communication protocols, and/or other communication techniques may be used to acquire the location/position information. A radio frequency transmission between 260 and 960 MHz may be used for direct communication between the trainable transceiver and the device. In other embodiments, a radio frequency transmission at 2.4 GHz or between 5 and 5.8 GHz may be used for direct communication between the trainable transceiver and the device.

Based on the location/position of the trainable transceiver and the location/position of the device, the trainable transceiver determines an antenna heading corresponding to a communication path between the location of the trainable transceiver and the device. For example, the control circuit, location/position module, and/or control module may compute the heading between the two locations using an algorithm, lookup table, formula, function, model, and/or other technique. The orientation of the antenna and/or trainable transceiver, the location of the trainable transceiver, and the location of the receiver may be used to determine an angle between the typical antenna transmission direction and the communication path between the trainable transceiver and the device. This angle may be the antenna heading or may be used to determine the antenna heading based on a coordinate system, magnetic headings, true headings, latitude and longitude coordinate system, or other system.

At 420, based on the antenna heading, the trainable transceiver transmits a signal directed toward the location/position of the receiver (e.g., home electronics device, remote device, or other device receiving the transmission). In some embodiments, the trainable transceiver uses beamforming and/or antenna phasing to direct the transmission along the antenna heading and toward the receiver. For example, the control circuit, control module, and/or transceiver circuit may cause the antenna to create a directed transmission by phasing multiple antennas and/or antenna elements of the antenna. In further embodiments, one or more of the other directional control or control techniques described herein may be used in place of or in conjunction with beamforming and/or antenna phasing. For example, a single antenna may be mechanically scanned to direct the transmission toward the receiver. A subset of antennas may be selected with beam patterns directed in or near the direction of the antenna heading. The beam pattern may be manipulated to direct the transmission towards the receiver. Signal strength, antenna power, and/or other characteristics related to the transmission may be modified.

In some embodiments, transmitting the signal toward the receiver may include further actions which increase the signal strength, signal reliability, or otherwise enhance communication with the receiver. For example, the trainable transceiver (e.g., using the control circuit and/or control module) may steer or shift the beam of the transmission away from the antenna heading by an predetermined amount to increase the likelihood that the transmission is received by the receiver (e.g., if the receiver is located at a position not directly corresponding with the heading).

Figure 5A:
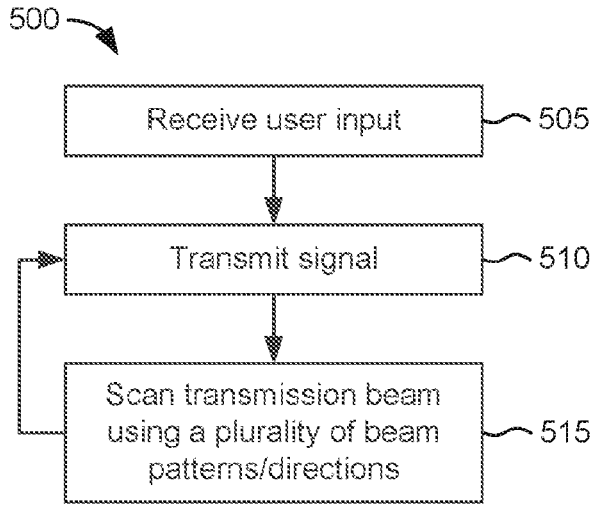
FIG. 5A illustrates a flow chart for a method of controlling the transmission of a signal from the trainable transceiver by scanning the transmission, according to an exemplary embodiment.
Figure 5B:
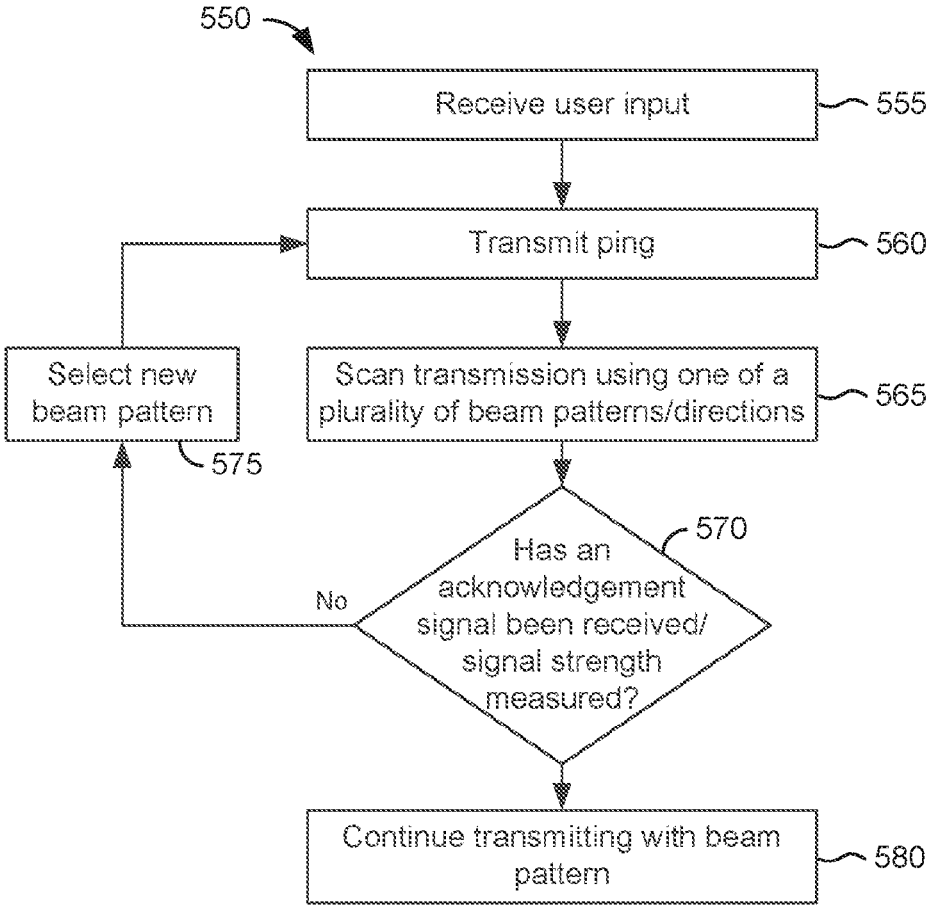
FIG. 5B illustrates a flow chart for a method of controlling the transmission of a signal from the trainable transceiver based on a received acknowledgement signal, according to an exemplary embodiment.

Referring now to FIGS. 5A and 5B, flow charts 500, 550 are illustrated for methods of controlling transmissions by the trainable transceiver (e.g., trainable transceiver 300) when the home electronics device and/or remote device (e.g., home electronics device and/or remote device 240) is located at an unknown location/position. The transmission can be scanned to produce a plurality of beam patterns and/or directional transmissions using one or more of the techniques described with respect to FIG. 3. For example, beamforming, mechanically scanning an antenna, iteratively selecting one of a plurality of available antennas for transmission, and/or other techniques may be used to scan a transmission and resulting beam pattern in a variety of directions.

Referring now to FIG. 5A, in some embodiments, the trainable transceiver does not have information related to the position/location of the receiver (e.g., home electronics device and/or remote device) to which the trainable transceiver is transmitting, and the trainable transceiver does not determine the location/position of the receiver to which the trainable transceiver is transmitting. The trainable transceiver may scan a repeated signal by transmitting the signal sequentially in a plurality of directions. This may increase the range of the trainable transceiver by increasing the likelihood that the receiver will be located within a main lobe of the beam pattern transmitted during transmission in one of the plurality of transmissions. For example, the trainable transceiver may transmit an activation signal using a first direction and repeat the transmission at directions every 15 degrees from the first direction. This may increase the chance that the transmission is directed toward the receiver and increase the likelihood that the signal is received by the receiver.

At 505, the trainable transceiver may receive a user input which corresponds to transmitting a signal. For example, the input may be a button press corresponding to sending an activation signal formatted to control a device (e.g., home electronics device and/or remote device) the trainable transceiver has been trained to control.

At 510, in response to receiving the user input, the trainable transceiver may transmit a signal corresponding to the user input. For example, an activation signal may be transmitted. The signal is transmitted in a first direction.

At 515, the trainable transceiver may scan the transmission beam across a plurality of directions. For example, with each transmission, the trainable transceiver (e.g., using the control circuit and/or control module) may direct the transmission using one or more techniques described herein (e.g., phasing an antenna array, mechanically directing an antenna, and/or other technique) While scanning the transmission beam, the trainable transceiver may continue to transmit the activation signal. This may be an iterative process. For example, the trainable transceiver may transmit using directions separated by a predetermined amount (e.g., fifteen degrees) across 360 degrees from the first transmission direction.

In some embodiments, the scanning of the transmission may be combined with one or more other techniques described herein. For example, a plurality of different beam patterns may be used in the transmission. A plurality of different beam patterns may be used for each transmission direction or a different beam pattern may be used for each one direction.

Referring now to FIG. 5B, in some embodiments, the trainable transceiver does not initially have information related to the location/position of the receiver to which the trainable transceiver is transmitting, but the trainable transceiver determines a specific beam pattern to use based on the reception of an acknowledgement signal from the receiver.

At 555, the trainable transceiver may receive a user input which corresponds to transmitting a signal. For example, the input may be a button press corresponding to sending an activation signal formatted to control a device (e.g., home electronics device and/or remote device) the trainable transceiver has been trained to control.

At 560, in response to the user input, the trainable transceiver transmits a ping signal. For example, the control circuit and/or control module may cause the transceiver circuit to format a ping for reception by the receiver of a particular home electronics device and/or remote device corresponding with the user input. The ping and/or transmitted signal may be configured such that, if received, the home electronics device and/or remote device with transmit an acknowledgement signal to the trainable transceiver (e.g., the transceiver circuit may receive the signal).

At 565, the trainable transceiver may scan the transmission of the ping using one of a plurality of beam patterns and/or directions. For example, the trainable transceiver (e.g., using the control circuit and/or control module) may transmit the ping in a first direction. At 570, the trainable transceiver may determine if an acknowledgement signal has been received and/or if a signal strength has been measured. If an acknowledgment signal is not received in response to the transmitted ping, then at 575, the trainable transceiver may select a new beam pattern and/or transmission direction (e.g., using the control circuit and/or control module). Using the new beam pattern and/or transmission direction, the trainable transceiver may transmit a second ping using a transmission which has a different beam pattern and/or transmission direction (e.g., antenna heading) than the first transmission. This process may be iterative until an acknowledgement signal is received in response to a transmitted ping. The control circuit and/or control module may have a set sequence of various beam patterns and/or transmission directions which are used sequentially. Beam patterns and transmission directions may be varied simultaneously.

In response to receiving an acknowledgment signal from a home electronics device, remote device, and/or other device, the trainable transceiver may stop selecting new beam patterns and/or transmission directions for use in transmitting to the receiver of the device. At 580, the trainable transceiver continues to transmit with the last beam pattern and/or transmission direction (e.g., antenna heading) used. This beam pattern and/or transmission direction is the one which resulted in a transmitted ping reaching the receiver of the device. The device transmitted the acknowledgement signal in response to the ping. Advantageously, these and/or other similar steps allow the trainable transceiver to locate the device to which it is transmitting which allows for further communications, enhanced range of communications, more reliable communications, and/or otherwise enhances or improves communication with the device. In alternative embodiments, the trainable transceiver may not receive a specific transmission indicating acknowledgement that the signal has been received. For example, the transmission from the home electronics device may not include acknowledgement information, but the trainable transceiver may measure the signal strength of the received transmissions to determine if the home electronics device has received the transmission from the trainable transceiver.

In further embodiments, the beam pattern and/or transmission direction may be shifted or otherwise altered after the acknowledgement signal has been received. For example, the transmission direction may be shifted plus or minus one beam width in one or more directions in order to enhance communications with the device. The beam pattern and/or transmission direction may be altered to further improve communications after having established communication using the steps detailed above and/or other steps. The beam pattern and/or transmission direction may be altered to improve communications using any of the techniques described herein and/or other techniques. For example, further communications from the device may be analyzed by the trainable transceiver (e.g., using the transceiver circuit, control circuit, and/or control module) using received signal strength indicator data to better determine the location of the device relative to the trainable transceiver. This information may be used to adjust the beam pattern and/or transmission direction for further communication with the device.

Example Applications for a Trainable Transceiver which Directs Transmissions

Figure 6A:
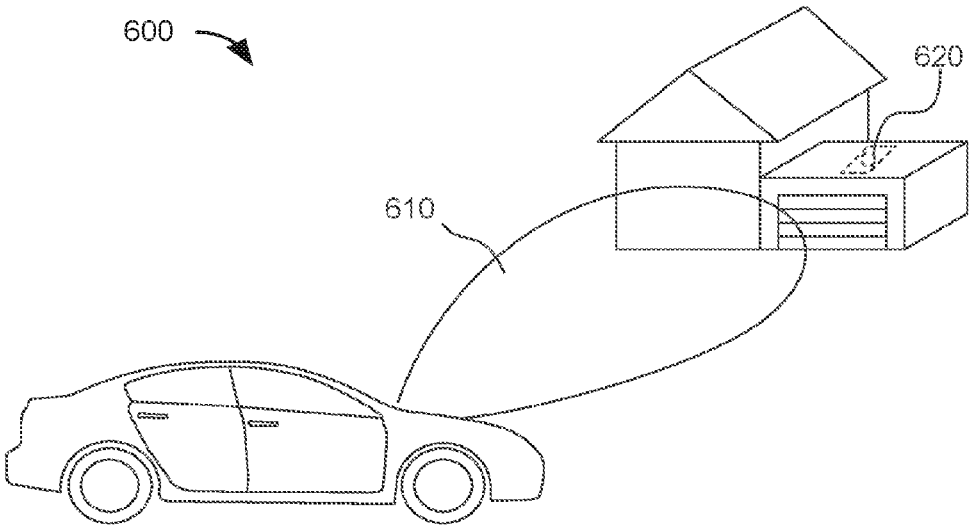
FIG. 6A illustrates a trainable transceiver in a vehicle communicating with a home electronics device at a home using location/position information, according to an exemplary embodiment.

Referring now to FIG. 6A, a schematic diagram 600 is illustrated in which a trainable transceiver (e.g., trainable transceiver 300) may use beamforming and/or one of the other techniques described herein to transmit a signal 610 (e.g., an activation signal) towards a home electronics device 620. Home electronic device 620 may be similar or identical to home electronic device and/or remote device 240. For example, a trainable transceiver may have been trained to control a home electronics device 620 such as a garage door opener. During the training process, the location of the home electronics device 620 may have been determined using a location/position sensors of the trainable transceiver and stored in memory. When a user provides an input corresponding to the home electronics device 620 (e.g., a button press for transmitting an activation signal and/or other signal received via the operator input device), the trainable transceiver recalls the location/position of the home electronics device 620 from memory (e.g., using the control circuit).

The trainable transceiver may also determine its own location/position. The trainable transceiver may determine its own location/position using one or more of the location/position sensors described herein and/or one or more of the techniques described herein. For example, the control circuit may determine the location of the trainable transceiver based on GPS information received. Based on the location of the home electronics device 620 and the trainable transceiver, the trainable transceiver may determine a transmission direction (e.g., antenna heading) and/or beam pattern for use in transmitting the signal 610 (e.g., activation signal, status request signal, and/or other signal) to the home electronics device 620. For example, the control circuit, location/position module, and/or control module may process the location information using one or more of the techniques described herein and/or other techniques. The trainable transceiver may then transmit the signal 620 to the home electronics device.

Figure 6B:
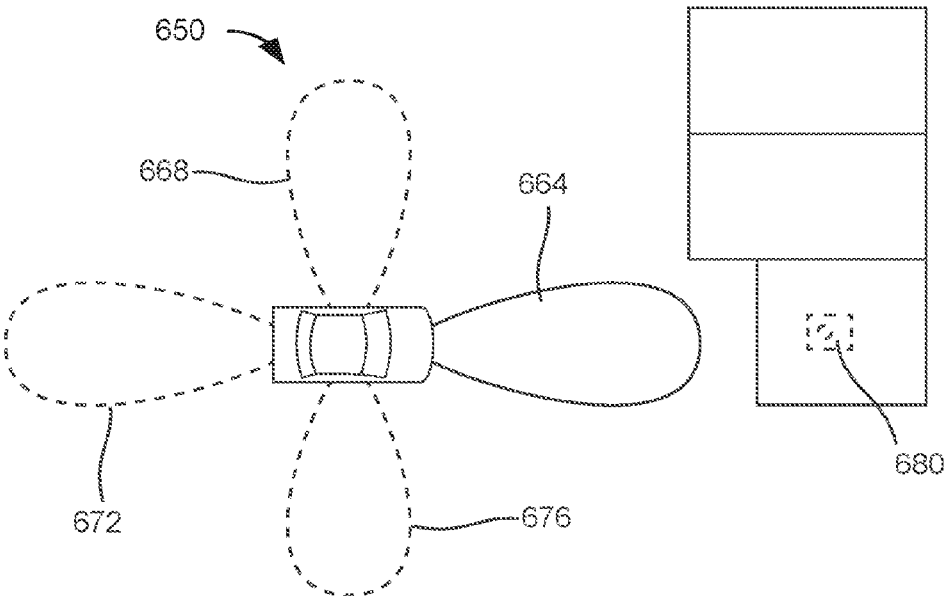
FIG. 6B illustrates a trainable transceiver in a vehicle communicating with a home electronics device by scanning a transmission, according to an exemplary embodiment.

Referring now to FIG. 6B, a schematic diagram 650 is illustrated in which the trainable transceiver may use beamforming and/or one of the other techniques described herein to transmit a signal (e.g., an activation signal) towards a home electronics device by scanning the signal in a plurality of directions and/or beam patterns (e.g., patterns 664, 668, 672, 676, etc.). For example, the trainable transceiver may not know the location/position of the home electronics device 680. In the case of transmitting an activation signal, the trainable transceiver may transmit the activation signal using a plurality of transmission directions sequentially. This may increase the chance that the activation signal is received by a home electronics device which is at an unknown location relative to the trainable transceiver. The trainable transceiver may control the transmissions such that there is a reduced likelihood of the home electronics device and/or other device receiving the same activation signal more than one in response to a single user input. For example, the beam patterns and/or transmission directions selected by the trainable transacted may not overlap, substantially not overlap, or otherwise be configured to avoid reception of the same activations signal multiple times by a single home electronics device. For example, the trainable transceiver may transmit the activation signal along an antenna heading of 0 degrees (e.g., pattern 664), 90 degrees (e.g., pattern 668), 180 degrees (e.g., pattern 672, and 270 degrees (e.g., pattern 676) relative to forward motion of the vehicle (in a frame of reference in which relative angles are measured counterclockwise from the origin; a clockwise frame of reference or other frames of reference may also be used). The beam pattern used for the transmissions may be directional or strongly directional to prevent substantial overlap of transmitted beam patterns. In other embodiments, other antenna headings and/or beam patterns may be used. In further embodiments, other techniques may be used in conjunction with scanning the transmission such as using an acknowledgement signal to determine a location of the home electronics device 680 or other device and/or other techniques described herein.

Figure 7A:
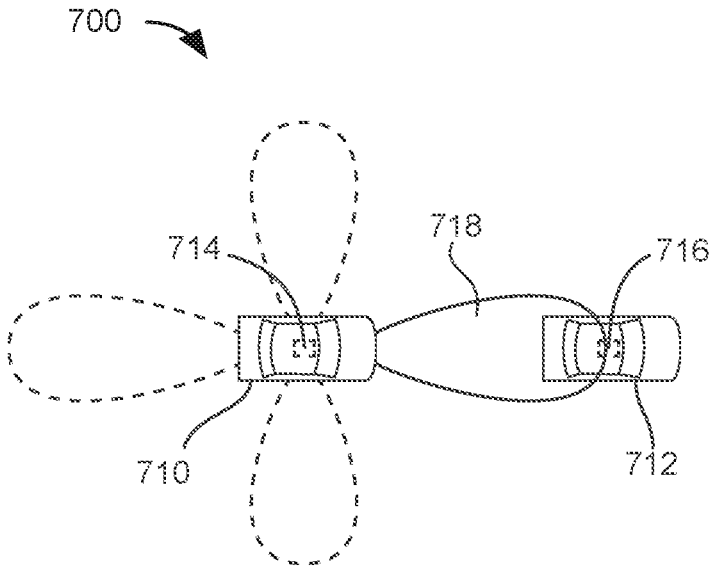
FIG. 7A illustrates a trainable transceiver in a first vehicle communicating with a second trainable transceiver in a second vehicle using location/position information, according to an exemplary embodiment.
Figure 7B:
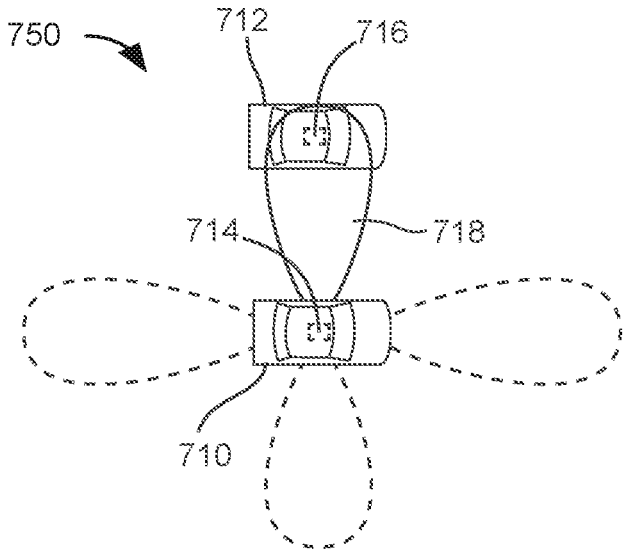
FIG. 7B illustrates a trainable transceiver in a first vehicle communicating with a second trainable transceiver in a second vehicle using a scanned transmission, according to an exemplary embodiment.

Referring now to FIGS. 7A and 7B, schematic diagrams 700, 750 are illustrated in which a trainable transceiver 714 of a first vehicle 710 may use one or more beam forming techniques described herein to transfer configuration information to a second trainable transceiver 716 of a second vehicle 712. Trainable transceivers 714, 716 may be similar or identical to trainable transceiver 300. Configuration information may be or include information used in setting up a trainable transceiver 300 and/or in controlling home electronics device, remote device and/or other devices. For example, configuration information may include the information used by the trainable transceiver to format activation signals and/or otherwise communication with the devices the trainable transceiver is trained to control (e.g., encryption information, frequency information, etc.). Configuration information may further include user preferences for the trainable transceiver. For example, configuration information may include information related to which buttons, other input devices, or inputs correspond with which of a plurality of device the trainable transceiver is trained to control. Advantageously, transferring configuration information from one trainable transceiver to another allows a user to control the user's devices and/or maintain the same user experience across multiple trainable transceivers. For example, a user may acquire a new vehicle and use one or more of the techniques described herein to transfer configuration information from a trainable transceiver located in one vehicle 710 (e.g., integrated with the vehicle) to a second trainable transceiver located in a second vehicle 712 (e.g., a newly purchased or otherwise acquired vehicle). In other embodiments, the second transceiver may be located in other locations (e.g., not within a second vehicle).

Referring now to FIG. 7A, the trainable transceiver 714 may use beamforming and/or one of the other techniques described herein to transmit a signal (e.g., including configuration information) to a second trainable transceiver 716 in a second vehicle 712. In some embodiments, the first trainable transceiver 714 may know or be provided with the location/position of the second trainable transceiver 716 and/or the second vehicle 712. For example, the user may provide, via the operator input device, information such as the second vehicle 712 is located to the right, left, front, or behind of the first vehicle 710. This information may be requested by a prompt of the trainable transceiver 714 as part of the transfer of configuration information. In other embodiments, the two trainable transceivers 714, 716 may be in communication with one another (e.g., via transceiver circuits, via Bluetooth transceivers, and/or using other communications techniques). The two trainable transceivers 714, 716 may exchange location/position information or the trainable transceiver 714 having the configuration information may request the location/position of the second trainable transceiver 716.

Using the location/position information corresponding to the second trainable transceiver 716, the first trainable transceiver 714 may determine a transmission direction and/or beam pattern for use in transmitting the configuration information to the second trainable transceiver 716. For example, the trainable transceiver 714 (e.g., using the control circuit, location/position module, and/or control module) may direct a transmission of configuration information along a particular antenna heading towards the second trainable transceiver and using a directional beam pattern (e.g., beam pattern 718) in response to determining that the second trainable transceiver 716 is at a distance away from the first trainable transceiver 714 greater than a predetermined threshold amount. If the trainable transceiver 714 determines that the second trainable transceiver 716 is located within a threshold distance, an omni directional beam pattern may be used.

Referring now to FIG. 7B, the trainable transceiver 714 may use beamforming and/or one of the other techniques described herein to transmit a signal (e.g., including configuration information) to a second trainable transceiver 716 in a second vehicle 712 by scanning the signal in a plurality of directions and/or beam patterns (e.g., beam pattern 718, etc.). For example, the first trainable transceiver 714 may be unable to retrieve location/position information for the second trainable transceiver 716, a user may fail to provide this information, and/or the first trainable transceiver 714 may otherwise not have access to location/position information for the second trainable transceiver 716. In this case, the first trainable transceiver 714 may use one or more techniques to transmit the configuration information to the second trainable transceiver 716. For example, the first trainable transceiver 714 may transmit the configuration information by scanning the transmission across a plurality of directions and/or using a plurality of beam patterns. The first trainable transceiver 714 may use a scanned ping signal and acknowledgement signal received from the second trainable transceiver 716 to determine the location of the second trainable transceiver 716. The first trainable transceiver 714 may use an omni direction transmission to transmit the configuration information.

Figure 8:
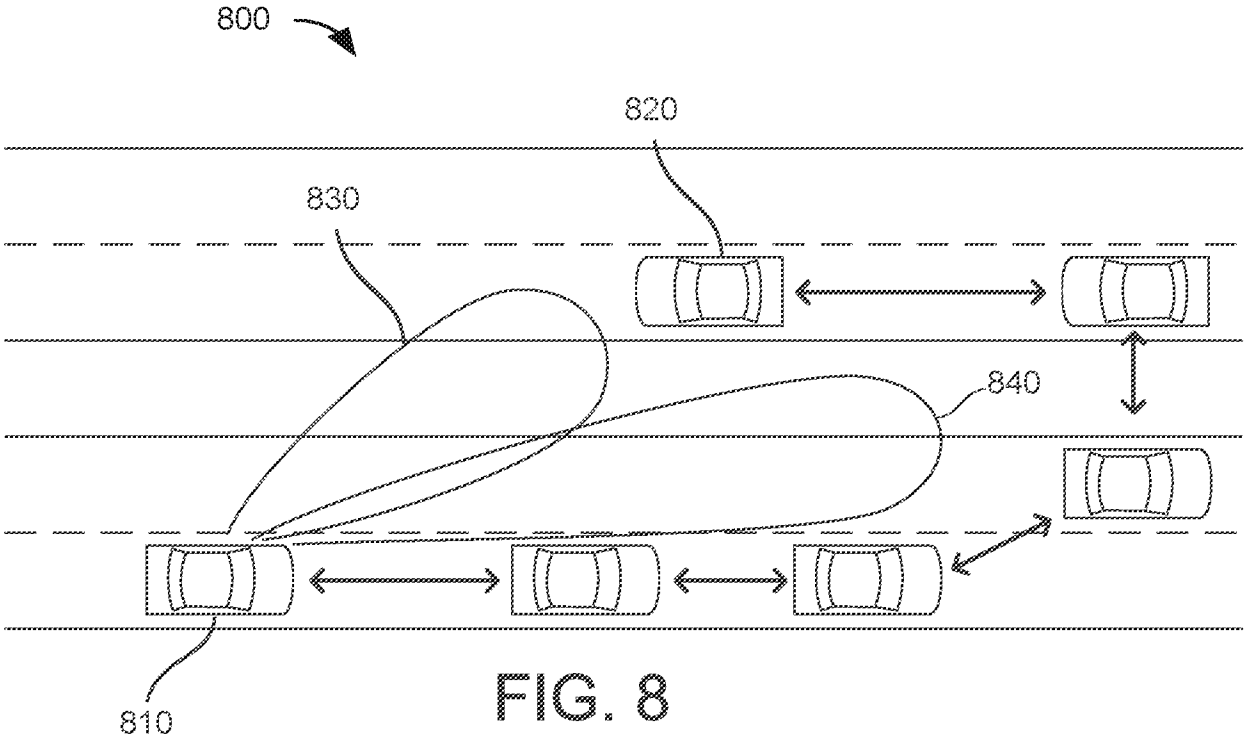
FIG. 8 illustrates a trainable transceiver in a moving vehicle in communication with a second moving vehicle using variable beam patterns, according to an exemplary embodiment.

Referring now to FIG. 8, a schematic diagram is illustrated in which the trainable transceiver 800 may use beamforming and/or one of the other techniques described herein to transmit a signal from a first moving vehicle 810 to a second moving vehicle 820. Information transmitted by the signal may include information about the vehicle 810 received at the trainable transceiver from one or more vehicle systems. For example, the information may include vehicle speed, vehicle heading, a navigation destination, and/or other information. The information may also be information about the vehicle 810 determined by the trainable transceiver. For example, the trainable transceiver may use one or more location/position sensors to determine the vehicle speed, vehicle heading, and/or other information.

In some embodiments, the trainable transceiver may request, be provided, have access to, or otherwise have determined the location of one or more other vehicles 820 to which the transmission is to be sent. For example, the trainable transceiver may determine the location of the other vehicle(s) 820 using information about the other vehicle(s) 820, such as speed and heading, received in prior communications with the vehicle(s) 820. In other embodiments, one or more vehicles 820 and/or one or more other transceiver types other than that used by the transceiver circuit of the trainable transceiver may be used to provide the location/position information of the other vehicle(s) 820. For example, short range transceivers and multiple intermediate vehicles 820 may be used to pass location information which is used by the trainable transceiver to direct a transmission to a vehicle 820 located beyond the range of the short range transceivers. In other embodiments, a long range transceiver with a communications range greater than that of the transceiver circuit may be used to acquire location/position information for the other vehicle(s). For example, a cellular network transceiver may be used.

Based on the location/position information of the other vehicle(s) 820, the trainable transceiver may use one or more of the beamforming techniques, beam pattern selection techniques, and/or other communication techniques described herein in order to communicate with the other vehicle(s) 820. For example, the trainable transceiver may direct a transmission along an antenna heading determined to correspond with a communication path between the vehicle and another vehicle, such as along antenna headings corresponding to beam patterns 830, 840, etc.

Further Embodiments of the Trainable Transceiver

The trainable transceiver as described herein may have various alternative configurations in alternative embodiments. Some alternative embodiments are described as follows. Referring again to FIG. 2, and in greater detail, an exemplary embodiment of a trainable transceiver 200 is illustrated along with an exemplary embodiment of a home electronics device/remote device 240 and an exemplary embodiment of an original transmitter 280. In one embodiment, the trainable transceiver 200 includes an operator input device 204. The operator input device 204 may be one or more buttons. For example, the operator input device 204 may be three hard key buttons. In some embodiments, the operator input device 204 may include input devices such as touchscreen displays, switches, microphones, knobs, touch sensor (e.g., projected capacitance sensor resistance based touch sensor, resistive touch sensor, or other touch sensor), proximity sensors (e.g., projected capacitance, infrared, ultrasound, infrared, or other proximity sensor), or other hardware configured to generate an input from a user action. In additional embodiments, the operator input device 204 may display data to a user or otherwise provide outputs. For example, the operator input device 204 may include a display screen (e.g., a display as part of a touchscreen, liquid crystal display, e-ink display, plasma display, light emitting diode (LED) display, or other display device), speaker, haptic feedback device (e.g., vibration motor), LEDs, or other hardware component for providing an output. In some embodiments, the operator input device 24 is connected to a control circuit 208. The control circuit 208 may send information and or control signals or instructions to the operator input device 204. For example, the control circuit 208 may send output instructions to the operator input device 204 causing the display of an image. The control circuit 208 may also receive input signals, instructions, and/or data from the operator input device 204.

The control circuit 208 may include various types of control circuitry, digital and/or analog, and may include a microprocessor, microcontroller, application-specific integrated circuit (ASIC), graphics processing unit (GPU), or other circuitry configured to perform various input/output, control, analysis, and other functions to be described herein. In other embodiments, the control circuit 208 may be a system on a chip (SoC) individually or with additional hardware components described herein. The control circuit 208 may further include, in some embodiments, memory 212 (e.g., random access memory, read only memory, flash memory, hard disk storage, flash memory storage, solid state drive memory, etc.). In further embodiments, the control circuit 208 may function as a controller for one or more hardware components included in the trainable transceiver 200. For example, the control circuit 208 may function as a controller for a touchscreen display or other operator input device 204, a controller for a transceiver, transmitter, receiver, or other communication device (e.g., implement a Bluetooth communications protocol).

The control circuit 208 is coupled to memory 212. The memory 212 may be used to facilitate the functions of the trainable transceiver 200 described herein. Memory 212 may be volatile and/or non-volatile memory. For example, memory 212 may be random access memory, read only memory, flash memory, hard disk storage, flash memory storage, solid state drive memory, etc. In some embodiments, the control circuit 208 reads and writes to memory 212. Memory 212 may include computer code modules, data, computer instructions, or other information which may be executed by the control circuit 208 or otherwise facilitate the functions of the trainable transceiver 200 described herein. For example, memory 212 may include encryption codes, pairing information, identification information, a device registry, etc. Memory 212 may include computer instructions, codes, programs, etc. which are used to implement the algorithms described herein.

The trainable transceiver 200 may further include a transceiver circuit 216 coupled to the control circuit 208. The transceiver circuit 216 allows the trainable transceiver 200 to transmit and/or receive wireless communication signals. Wireless communication signals may be or include activation signals, control signals, activation signal parameters, status information, notifications, diagnostic information, training information, instructions, and/or other information. The wireless communication signals may be transmitted to or received from a variety of wireless devices (e.g., an original transmitter, home electronic device, mobile communications device, and/or remote device). The transceiver circuit 216 may be controlled by the control circuit 208. For example, the control circuit 208 may turn on or off the transceiver circuit 216, the control circuit 208 may send data using the transceiver circuit 216, format information, an activation signal, control signal, and/or other signal or data for transmission via the transceiver circuit 216, or otherwise control the transceiver circuit 216. In some embodiments, the transceiver circuit 216 may include additional hardware such as processors, memory, integrated circuits, antennas, etc. The transceiver circuit 216 may process information prior to transmission or upon reception and prior to passing the information to the control circuit 208. In some embodiments, the transceiver circuit 216 may be coupled directly to memory 212 (e.g., to store encryption data, retrieve encryption data, etc.). In further embodiments, the transceiver circuit 216 may include one or more transceivers, transmitters, receivers, etc. For example, the transceiver circuit 216 may include an optical transceiver, near field communication (NFC) transceiver, etc. In some embodiments, the transceiver circuit 216 may be implemented as a system on a chip. The transceiver circuit 216 may be used to format and/or send activation signals to a device which cause the device to take an action and/or otherwise allows communication with the device. The activation signal may include activation signal parameters and/or other information. The transceiver circuit 216 may be or include a radio frequency transceiver (e.g., a transceiver which sends or receives wireless transmission using radio frequency electromagnetic radiation). For example, the transceiver circuit 216 and/or control circuit 208 may modulate radio waves to encode information onto radio frequency electromagnetic radiation produced by the transceiver circuit 216 and/or demodulate radio frequency electromagnetic radiation received by the transceiver circuit 216.

In some embodiments, the transceiver circuit 216 may include additional hardware such as one or more antennas, voltage controlled oscillator circuitry, amplifiers, filters, antenna tuning circuitry, volt meters, and/or other circuitry for the generation of and/or reception of modulated radio waves of different frequencies. The transceiver circuit 216 may provide for the functions described herein using techniques such as modulation, encoding of data onto a carrier wave, decoding data from a modulated carrier wave, signal strength detection, (e.g., computing and/or measuring voltage per length received by an antenna), antenna power regulation, and/or other functions related to the generation of and/or reception of radio waves. For example, the transceiver circuit 216 may be used to generate a carrier wave and encode onto the carrier wave (e.g., through modulation of the carrier wave such as frequency modulation or amplitude modulation) information such as control data, activation signal parameters, an encryption code (e.g., rolling code value), and/or other information. The transceiver circuit 216 may also be used to receive carrier waves and demodulate information contained within the carrier wave. The trainable transceiver 200 may be tuned (e.g., through antenna tuning) or otherwise controlled to send and/or receive radio waves (e.g., modulated carrier waves) at certain frequencies or channels and/or with a certain bandwidth.

The trainable transceiver 200 may communicate with original transmitters, home electronic devices, remote devices, mobile communications devices, network devices, and/or other devices as described above using the transceiver circuit 216 and/or other additional transceiver circuits or hardware. The devices with which the trainable transceiver 200 communicates may include transceivers, transmitters, and/or receivers. The communication may be one-way or two-way communication.

With continued reference to FIG. 2, a home electronics device or remote device 240 may include hardware components for communication with a trainable transceiver or original transmitter. In some embodiments, the home electronics device or remote device 240 includes a transceiver circuit 248. The transceiver circuit 248 may be used to send and/or receive wireless transmissions. For example, the transceiver circuit 248 may be or include a transceiver which sends and/or receives radio frequency electromagnetic signals. The transceiver circuit 248 may allow a home electronics device or remote device 240 to receive an activation signal and/or other transmission from a trainable transceiver or original transmitter. For example, a trainable transceiver may transmit an activation signal using activation signal parameters acquired as part of a training process. The home electronics device or remote device 240 may receive the activation signal using a transceiver circuit 248. The transceiver circuit 248 may be configured to transmit signals to a trainable transceiver, original transmitter, and/or other device. For example, the home electronics device or remote device 240 may transmit status information (e.g., that a garage door is closed) or other information. In some embodiments, the trainable transceiver 200 is configured to send and/or receive signals using multiple channels (e.g., a plurality of frequencies of radio waves used for communication). The transceiver circuit 248 of the home electronics device or remote device 240 may function in the same or similar manner as described with reference to the transceiver circuit 216 of the trainable transceiver 200.

The home electronics device or remote device 240 includes memory 244 and/or a control circuit 252 in some embodiments. The memory 244 and/or control circuit 252 may facilitate and/or carry out the functions of the home electronics device or remote device 240 described herein. The control circuit 252 and/or memory 244 may be the same or similar to the control circuit 208 and/or memory 212 described with respect to the trainable transceiver 200. For example, the control circuit 252 may be or include a processor and the memory 244 may be or include volatile (e.g., flash memory) and/or non-volatile memory (e.g., hard disk storage). The control circuit 252 may carry out computer programs, instructions, and or otherwise use information stored in memory 244 to perform the functions of the home electronics device or remote device 244. For example, the control circuit 252 and memory 244 may be used to process an activation signal (e.g., perform encryption related tasks such as comparing a received key with a stored key, handling instructions included in the signal, executing instructions, processing information, and/or otherwise manipulating or handling a received signal) received by the transceiver circuit 248 and/or control an interaction device 260 in response to the activation signal.

The home electronics device or remote device 240 may further include an interaction device 260. The interaction device may allow the home electronics device or remote device 240 to interact with another device, component, other hardware, the environment, and/or otherwise allow the home electronics device or remote device 240 to affect itself or something else. The interaction device 260 may be an electrical device such as a light, transceiver, networking hardware. The interaction device 260 may also or alternatively be an electromechanical device such as electric motor, solenoid, or other hardware. The home electronics device or remote device 240 (e.g., a garage door opener) may transmit a signal to a trainable transceiver or original transmitter from which the activation signal originated. The transmission may include information such as receipt of the activation signal, status information about the garage door opener or associated hardware (e.g., the garage door is closed), and/or other information.

In some embodiments, the home electronics device or remote device 240 includes one or more sensors 256. Sensors 256 may be used by the device 240 to monitor itself, the environment, hardware controlled by the device, and/or otherwise provide information to the device. Sensors 256 may provide status information to the device. For example, sensors 256 may be or include, temperature sensors (e.g., thermistor, thermocouple, or other hardware for measuring temperature), movement or acceleration sensors (e.g., accelerometers, inclinometers, or other sensors for measuring orientation, movement, or a derivative thereof), safety beams (e.g., sensors which detect when an infrared, or other spectrum, beam of light is broken by an object), sensor which detect distance (e.g., an ultrasound emitter and receiver configured to determine distance of an object), pressure sensors (e.g., pressure transducer, strain gauge, etc.), or other sensor. In some embodiments, one or more sensors 256 are configured to determine the status of a garage door opener or garage door. For example, a pressure sensor may be used to determine if a garage door is closed (e.g., in contact with the ground and/or sensor.

With continued reference to FIG. 2, components of an original transmitter 280 are illustrated according to an exemplary embodiment. The original transmitter 280 may include a transceiver circuit 284. As described with reference to the trainable transceiver 200, the transceiver circuit 284 of the original transmitter 280 may allow the original transmitter 280 to send transmissions to an associated device (e.g., home electronics device or remote device 240) and/or receive transmissions from an associated device. For example, an original transmitter 280 may send an activation signal to an associated device and/or may receive status information and or other information from the associated device.

The original transmitter may include a control circuit 288 and/or memory 292. The control circuit 288 and/or memory 292 may facilitate the functions of the original transmitter 280 in the same or similar fashion as described with reference to the trainable transceiver 200. For example, the control circuit 288 may receive a user input from an operator input device (e.g., button). The control circuit 288 may cause the transceiver circuit 284 to transmit an activation signal in response. One or more activation signal parameters may be read by the control circuit 288 from memory 292. For example, the memory of the original transmitter 280 may be non-volatile and store activation signal parameters for an associated device such as a frequency used to receive or send transmissions, frequencies used for the same, channels used for the same, encryption information (e.g., rolling code values, a seed value, etc.), device identification information, modulation scheme, and/or other information.

The transceiver circuit 216 of the trainable transceiver 200 and the transceiver circuit 248 of the home electronics device 240, remote device 240, original transistor, and/or other device may be configured to communicate send and/or receive wireless signals (e.g., activation signals, communication signals, and/or other signals). This may allow for communication between the trainable transceiver 200 and other device 240. In one embodiment, the transceiver circuits are configured to transmit and/or receive radio frequency transmissions. Communication between the trainable transceiver 200 and other device 240 may be unidirectional or bi-directional. In some embodiments, the trainable transceiver 200 and/or other device 240 may be configured to communicate using multiple frequencies. Each frequency may be a channel used for communication. A home electronics device 240, remote device 240, original transmitter 280, or other device may be configured to communicate using multiple channels for sending and/or receiving radio frequency transmissions using a transceiver circuit 248. For example, a home electronics device 240 (e.g., garage door opener) may be configured to communicate using multiple channels in the 900 MHz band. Continuing the example, a first channel may be 903.925 MHz and a second channel may be 904.075 MHz. In some embodiments, a single channel is used for transmission and/or reception. In other embodiments, a plurality of channels (e.g., two or more channels) are used for communication by the home electronics device 240, remote device 240, original transmitter 280, and/or other device.

The trainable transceiver 200 may be trained to use the same plurality of channels or single channel thereby allowing the trainable transceiver 200 to communicate with the device. The trainable transceiver 200 may be trained (e.g., through a training procedure) to send and/or receive radio frequency transmissions using the channel(s) the device is configured to use for transmitting and/or receiving transmissions. The trainable transceiver 200 may store the channel information and/or other information as activation signal parameters for use with the corresponding device. The trainable transceiver may store activation signal parameters (including channel frequencies used by the device) for one or more devices. Using the control circuit 208, memory 212, and/or transceiver circuit 216, the trainable transceiver 200 may format activation signals for a plurality of devices. This allows a single trainable transceiver 200 to control a plurality of devices depending on the user input. For example, a trainable transceiver 200 may receive a first user input and format a first activation signal for the device corresponding to a first device associated with the user input. The first activation signal may include or use a first channel or group of channels associated with the first device. This may allow the first device to communicate with the trainable transceiver using a plurality of channels. Continuing the example, a trainable transceiver 200 may receive a second user input and format a second activation signal for the device corresponding to a second device associated with the user input. The second activation signal may include or use a second channel or group of channels associated with the second device. This may allow the second device to communicate with the trainable transceiver 200 using a plurality of channels.

A trainable transceiver 200 may be trained to an existing original transmitter 280 such that the trainable transceiver 200 may control the device associated with the original transmitter 280. For example, a user may place the trainable transceiver 200 and original transmitter 280 such that the trainable transceiver 200 is within the transmission range of the original transmitter 280. The user may then cause the original transmitter 280 to send an activation signal or other transmission (e.g., by depressing a button on the original transmitter 280). The trainable transceiver 200 may identify one or more activation signal parameters, the device, and/or other information based on the transmission from the original transmitter 280 which the trainable transceiver 200 may receive using the transceiver circuit 216. The control circuit 208, memory 212, and/or other transceiver circuit may identify, determine, and or store information such as the frequency, frequencies, or channels used by the original transmitter 280 and therefore the device associated with the original transmitter 280, a control code or other encryption information, carrier frequency, bandwidth, and or other information.

In some embodiments, the home electronics device 240, remote device 240, or other device may be configured to learn an identifier, encryption information, and/or other information from a trainable transceiver 200. For example, the device may be placed in a learning mode during which time a user sends a transmission from the trainable transceiver 200 (e.g., by providing an input causing the transmission). The device may receive the transmission and perform a function in response. For example, the device may send an acknowledgement transmission in response to receiving the transmission, send a transmission including a ready indication (e.g., that the device is synchronized with the trainable transceiver, encryption information has been exchanged, communication has been acknowledged on all channels used by the device, etc.), store an identifier of the trainable transceiver 200, and/or perform other functions. This may process may constitute a pairing of the trainable transceiver 200 and the home electronics device 240, remote device 240, or other device. For systems using a rolling code, the trainable transceiver 200 and device may be synchronized so that the counters of the trainable transceiver 200 and the device begin with the same rolling code value.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for controlling a device, comprising:

an antenna array including at least two antennas, the antenna array configured to direct a transmission;

at least one location sensor; and a control circuit coupled to the antenna array and coupled to the at least one location sensor, wherein the control circuit is configured to control the antenna array to direct the transmission along an antenna heading corresponding to a communication path between the trainable transceiver and the device, and wherein the control circuit is configured to determine the communication path based on (A) a location of the trainable transceiver determined by the control circuit based on information from the at least one location sensor and (B) a location of the device determined by the control circuit.

2. The trainable transceiver of claim 1, wherein the control circuit is configured to determine the location of the device based on location information corresponding to the device stored in memory.

3. The trainable transceiver of claim 2, wherein the control circuit is configured to store in memory the location of the device when the trainable transceiver is trained to control the device.

4. The trainable transceiver of claim 2, wherein the control circuit is configured to receive location information corresponding to the location of the device from at least one of a vehicle system, a mobile phone, or a network source.

5. The trainable transceiver of claim 1, wherein the control circuit is configured to store in memory the location of the device based on the location of the trainable transceiver when trained to control the device, determined by the control circuit based on information from the at least one location sensor.

6. The trainable transceiver of claim 1, wherein the control circuit is configured to determine the location of the device based on an acknowledgement signal received at the trainable transceiver from the device.

7. The trainable transceiver of claim 6, wherein the acknowledgement signal is sent by the device in response to a ping transmitted by the trainable transceiver in a plurality of directions.

8. The trainable transceiver as in claim 1, wherein the control circuit is configured to determine the location of vehicle structural elements in relationship to the trainable transceiver, and wherein the control circuit is further configured to control the antenna array to at least one of (A) alter a direction of the transmission to at least partially avoid one or more vehicle structural elements, (B) alter a beam pattern produced by the antenna array to at least partially avoid one or more vehicle structural elements, or (C) increase an antenna power of the antenna array.

9. The trainable transceiver as in claim 1, wherein the antenna array includes at least one of a dipole antenna, a loop antenna, a slot antenna, a parabolic reflector, a monopole antenna, a helical antenna, or a wire antenna.

10. The trainable transceiver as in claim 1, wherein the control circuit is configured to direct the transmission by at least one of mechanically steering the antenna array or phasing the antenna array.

11. A method of controlling a transmission from a trainable transceiver to a device, comprising:

determining, using a control circuit, the location of the trainable transceiver;

determining the location of the device;

determining, using the control circuit, an antenna heading corresponding to a communication path between the trainable transceiver and the device;

transmitting, using an antenna and the control circuit, the transmission along the antenna heading, wherein the trainable transceiver is configured to be capable of controlling the device based on at least one signal characteristic stored in memory.

12. The method of claim 11, further comprising:

training the trainable transceiver to control the device;

determining the location of the trainable transceiver during training;

storing the location of the trainable transceiver during training as the location of the device.

13. The method of claim 11, further comprising receiving the location of the device from a source other than the trainable transceiver and other than the device.

14. The method of claim 13, wherein the source is a vehicle system, a mobile phone, or a network source.

15. The method of claim 11, further comprising at least one of mechanically steering the antenna to direct the transmission along the antenna heading or phasing the antenna to direct the transmission along the antenna heading, the antenna including a plurality of antenna elements.

16. The method of claim 11, further comprising:

sequentially transmitting a ping from the trainable transceiver in a plurality of directions;

receiving an acknowledgement signal from the device in response to the transmitted ping;

using the transmission direction resulting in the reception of the acknowledgment signal as the antenna heading or to determine the location of the device.

17. The method of claim 11, further comprising:

shifting the antenna heading during transmission to increase an effective beam width of the transmission without decreasing gain.

18. The method of claim 11, further comprising:

determining, using the control circuit, a location of vehicle structural elements in relationship to the trainable transceiver; and controlling the antenna during transmission to at least one of (A) alter a direction of the transmission to at least partially avoid one or more vehicle structural elements, (B) alter a beam pattern produced by the antenna to at least partially avoid one or more vehicle structural elements, or (C) increase an antenna power of the antenna array.

19. The method of claim 11, wherein the antenna includes at least one of a dipole antenna, a loop antenna, a slot antenna, a parabolic reflector, a monopole antenna, a helical antenna, or a wire antenna.

20. The method of claim 11, wherein the device is a garage door opener, a barrier system, a gate system, a lighting system, a multimedia system, a second trainable transceiver, a mobile phone, a computer, or a vehicle.

* * * * *